US009175924B1

(12) United States Patent
Williford

(10) Patent No.: US 9,175,924 B1
(45) Date of Patent: Nov. 3, 2015

(54) TACTICAL ATTACHMENT SYSTEM FOR FIREARMS

(71) Applicant: Tommy Lynn Williford, Paso Robles, CA (US)

(72) Inventor: Tommy Lynn Williford, Paso Robles, CA (US)

( * ) Notice: Subject to any disclaimer, the term of this patent is extended or adjusted under 35 U.S.C. 154(b) by 0 days.

(21) Appl. No.: 14/545,646

(22) Filed: Jun. 1, 2015

Related U.S. Application Data

(63) Continuation-in-part of application No. 14/121,135, filed on Aug. 4, 2014, now Pat. No. 9,080,836, which is a continuation-in-part of application No. 13/999,588, filed on Mar. 10, 2014, now Pat. No. 9,080,835, which is a continuation-in-part of application No. 13/986,891, filed on Jun. 14, 2013, now Pat. No. 9,080,834, which is a continuation-in-part of application No. 13/986,170, filed on Apr. 8, 2013, now Pat. No. 9,080,833.

(60) Provisional application No. 61/639,950, filed on Apr. 29, 2012.

(51) Int. Cl.
*F41C 27/00* (2006.01)
*F41G 1/35* (2006.01)

(52) U.S. Cl.
CPC .. *F41C 27/00* (2013.01); *F41G 1/35* (2013.01)

(58) Field of Classification Search
CPC ..... F41A 35/00; F41C 23/00; F41C 23/16; F41C 27/00; F41C 27/16; F41C 27/18; F41G 1/35; F41G 11/001; F41G 11/002
USPC ..... 42/90, 85, 111, 114, 146, 148, 106
See application file for complete search history.

(56) References Cited

U.S. PATENT DOCUMENTS

| | | | |
|---|---|---|---|
| 951,657 | A | 3/1910 | Pederson |
| 993,817 | A | 5/1911 | Bennett |
| 1,148,297 | A | 7/1915 | Dickey |
| 1,702,221 | A | 2/1929 | Steele et al. |
| 3,018,577 | A | 1/1962 | Violette et al. |
| 3,513,581 | A | 5/1970 | Slater |
| 3,777,383 | A | 12/1973 | Haines et al. |
| 3,883,976 | A | 5/1975 | Norman et al. |
| 4,953,316 | A | 9/1990 | Litton et al. |
| 5,613,316 | A | 3/1997 | Hightower |
| 5,727,346 | A | 3/1998 | Lazzarini et al. |
| 6,565,226 | B1 | 5/2003 | Cummings |
| 6,722,076 | B2 | 4/2004 | Nielsen |
| 7,584,569 | B2 | 9/2009 | Kallio et al. |
| 8,418,393 | B1 | 4/2013 | Powers |
| 2003/0090894 | A1 | 5/2003 | Cummings |
| 2004/0045209 | A1 | 3/2004 | Nielsen |
| 2005/0188594 | A1 | 9/2005 | Tilby |
| 2007/0039225 | A1 | 2/2007 | Kallio et al. |
| 2007/0137087 | A1 | 6/2007 | Florea et al. |
| 2010/0277896 | A1 | 11/2010 | Oehlkers |

*Primary Examiner* — Jonathan C Weber
(74) *Attorney, Agent, or Firm* — Lorimer Labs; D'Arcy H. Lorimer

(57) ABSTRACT

A system for mounting a plurality of tactical attachments to firearms is disclosed. Tactical attachments such as laser illumination sights, flashlights, bayonets, and breaching tools are interchangeable and attached with a single adapter mounted to the end of a magazine ammunition tubes and auxiliary accessory rails such as Picatinny rails. Adapters of varying lengths provide increased ammunition capacity. The tactical devices have a common mounting structure for mating to the adapter, which includes a optional locking ring to assure the tactical device cannot become dislodged from the adapter during firearm usage. The adapter/tactical device interface allows rapid swapping of tactical devices without the need of tools.

8 Claims, 26 Drawing Sheets

500
106
108
110
502
304a
504

501
106
110
304a
502
504
410
406
408

503
106
304b
110
504
410
406
408

505
504
502
504
304a

TACTICAL ATTACHMENT SYSTEM FOR FIREARMS

REFERENCES TO PRIOR APPLICATIONS

This application is a continuation in, part of co-pending non-provisional application, Ser. No. 14/121,135, filed Aug. 4, 2014, entitled TACTICAL ATTACHMENT SYSTEM FOR FIREARMS, which is a continuation in part of co-pending non-provisional application, Ser. No. 13/999,588, filed Mar. 10, 2014, entitled TACTICAL ATTACHMENT SYSTEM FOR FIREARMS, which is a continuation in part of co-pending non-provisional application, Ser. No. 13/986,891, filed Jun. 14, 2013, entitled TACTICAL ATTACHMENT SYSTEM FOR FIREARMS, which is a continuation in part of co-pending non-provisional application, Ser. No. 13/986,170 filed Apr. 8, 2013, entitled TACTICAL ATTACHMENT SYSTEM FOR FIREARMS, which is further related to provisional application, Ser. No. 61/639,950 filed Apr. 29, 2012, entitled SHOTGUN TACTICAL ULTRA-ILLUMINATION DEVICE OR THE ACRONYM: S.T.U.D., and claims benefit thereof. Non-provisional application Ser. Nos. 13/999,588, 13/986,891, 13/986,170 and provisional application No. 61/639,950 are hereby incorporated by reference in their entirety.

BACKGROUND OF THE INVENTION

The invention relates to the design and structure of attachments and their mounting system for firearms. More specifically, the invention relates to tactical attachments mounted to a wide variety of firearms such as handguns, shotguns, and long guns.

Users of firearms often attach removable devices such as laser sights, flashlights, and other accessories to their weapon. Typically, these attachments require special brackets and mounting systems which are expensive and custom built, each "tactical" device or attachment having its own bracketing or mount. These custom mounts further require alignment with the firearm's point of aim, which can be time consuming to set up and are subject to misalignment if physically bumped during use. Some bracketing interferes with the use of the aiming sights on the weapon which can further hinder use.

If the weapon stores ammunition in a tubular style magazine, tactical attachments may be mounted to the end of the ammunition tube, replacing the stock cap employed by the manufacturer. This mounting method has the advantage of automatic alignment with the weapon's point of aim. Typically, this method has been utilized with pump style shotguns, although it may also be employed with other longs guns having tube magazines such as lever action rifles, for example.

FIG. 1 (Prior Art) is a side view 100 of a shotgun having an ammunition tube 106. Ammunition tube 106 and pump slide 104 are situated below the barrel 102. Ammunition spring 110 provides the force to feed ammunition (not shown) in the action of the weapon (not shown) for firing. Spring 110 is held within the ammunition tube 106 via cap 112 which is threaded onto ammunition tube 106 via threads 108. One example manufacturer making firearms as shown in FIG. 1 is Remington Arms Company LLC, of Madison N.C.

FIG. 17*a* (Prior Art) is a side view 1700 of a shotgun having an ammunition tube 1706 containing an integral ammunition spring. Retaining screw 1702 threads into ammunition tube 1706 and serves to help retain barrel 102 via lug 1704. FIG. 17*b* is an end view 1701 of the shotgun and barrel retaining lug 1704, showing 20 machined cavities 1708, which engage a ball detent fabricated within retaining screw 1702. FIG. 17*c* is a side view of retaining screw 1702 having a spring loaded ball detent device 1710. Firearms having this type of barrel retention system are distinguished from those illustrated in FIG. 1 (Prior Art), as prior art attachments designed for the firearms of FIG. 1 will not fit firearms as shown in FIGS. 17*a,b,c* (Prior Art). As an example, one manufacturer building shotguns shown in FIG. 17 is O.F. Mossberg and Sons, Inc., of North Haven Conn. The differences in construction between these two types of firearms often forces firearm owners to purchase redundant tactical attachments, which can be expensive, particularly for military or police organizations which may have both types of firearms in inventory for their personnel.

Patent Application Publication US 2010/0277896 A1 by Oehlkers discloses an example of a flashlight threaded on to the ammunition tube of a shotgun. The device combines a flashlight with extended ammunition capacity. One weakness of this approach is that a special flashlight device must be manufactured for every make and model of shotgun or long gun, which can be expensive for owners of multiple weapons. Another weakness is that the ammunition spring 110 is exposed every time the flashlight is removed or replaced with another device, which can lead to the spring launching from the ammunition tube 106 as the attachment is removed. It may also be difficult to re-install the spring if the magazine tube is full of ammunition. This can prove to be disruptive, particularly for peace officers or military personnel who rely on rapid exchange of tactical attachments during moments of high duress. Further, a thread on device 202, such as that shown in FIG. 2, may have the activation switch 204 end up in different locations, depending on the starting position prior to threading the unit 202 on. This can be troubling for military and peace officers who require "hands off" familiarity of their weapon, and can ill afford taking their eyes from the sight picture ahead to find the flashlight on/off switch.

U.S. Pat. No. 5,727,346 to Lazzarini et. al. discloses a device for mounting a flashlight or similar device into a holder attached to (below) slide 104. This system has the disadvantage that the device is mounted to a movable part, and therefore the accuracy (particularly of a laser illumination sight) is questionable. Furthermore, tactical attachments such as door breaching tools or ammunition extension tubes are not compatible with this mounting system.

U.S. Pat. No. 6,565,226 to Cummings discloses flashlight mounting system wherein the flashlight is mounted with a portion of the ammunition tube 106. This system has the disadvantage of consuming ammunition capacity, as a significant portion of the flashlight is mounted within the ammunition tube. It also requires the use of tools for the removal of the flashlight and adapters which would not be suitable for military or police field use. It is also suitable only for the larger gauge shotgun calibers, due the outside diameter requirements of the flashlight.

One method employed in the prior art for mounting gun sights, flashlights, laser sights, and other accessories to a firearm utilizes the Weaver or Picatinny Rail system. These are machined rails that can be attached to a firearm (or are built in to a component like a barrel or receiver) in a variety locations and via a wide variety of methods. Early versions of this system were known as Weaver rails, developed primarily for mounting telescopic type gun sights. These systems were not standardized, since the configurations were developed for a particular scope or application. Later, a standardized system called the Picatinny rail was provided for the US Military, which conformed to Mil-STD 1913. FIGS. 23*a-e*, 24*a,b*

(Prior Art) illustrate examples of these auxiliary accessory rail mount systems. Both the Weaver and Picatinny rail systems have similar cross section profiles (FIGS. 23*a,c* Prior Art). The differences lie in the width of the grooves and lands cut in the upper surface of the rail. The grooves cross cut in the upper surface of the rail are known as "recoil grooves", and are designed as a "stop" to reduce the impact of firearm recoil on the positioning of the device mounted on the upper surface of the rail. This can be critical for gun sights which cannot move during and after the discharge of the weapon.

Turning to the figures, FIG. 23*a* (Prior Art) is a front view 2300 of a Picatinny (or Weaver) auxiliary rail mount 2302. As shown, the upper portion has a dovetail which is used to mount devices via a clamp system. FIG. 23*b* (Prior Art) is a side view 2301 of rail mount 2302. This view shows the grooves and lands 2308. The width 2306 of a groove and the width 2304 of a land are specified and standardized in the Picatinny rail system by Mil-Std 1913, but are unspecified in a Weaver rail. The grooves between land 2308 are used to facilitate hardware (rods and bolts) which bear on the lands on either side of the groove, providing a hard stop which prevents motion during recoil. FIG. 23*c* (Prior Art) is a cross section view 2303 through section A-A of FIG. 23*b*. FIG. 23*d* (Prior Art) is a top view 2305 of auxiliary rail mount 2302. FIG. 23*e* (Prior Art) is a cross section view 2307 of a auxiliary rail mount 2302 with an example accessory clamp mount 2312 attached to the rail 2302. A typical clamp mount 2312 will be machined to engage the dovetails on the rail, and utilize a bolt 2314 and a floating portion 2310 to lock position on rail 2302 when the bolt 2314 is tightened. FIG. 24*a* (Prior Art) is a side view 2401 of a Picatinny auxiliary rail mounted to the cooling rib on the barrel of a shotgun. FIG. 24*b* (Prior Art) is an end view 2400 via section B-B of FIG. 24*a*. The advantage of the Picatinny/Weaver auxiliary rail mount system for attaching accessories such as scopes, sights, and lights is that the system is standardized. This means there is a wide variety of components available that fit this rail system. The downside is that most of these accessories are mounted with hardware that is bolted to the rail, requiring tools for the removal. Further, many precision devices like sights or scopes cannot be removed and remounted without re-calibration, which is time consuming and not practical in the field.

These and other limitations of the prior art will become apparent to those of skill in the art upon a reading of the following descriptions and a study of the several figures of the drawing.

SUMMARY OF THE INVENTION

It is an object of the present invention to provide a system for mounting a tactical attachment focused point breaching tool to a firearm having an ammunition tube with a threaded bore and a barrel retaining lug, the system containing a tactical attachment adapter having a firearm mounting end and an opposing tactical attachment mounting end, the firearm mounting end having a first bore fashioned therein, the tactical attachment mounting end having a cavity fashioned therein, the tactical attachment mounting end having one or more pins extending into said cavity; a mounting bolt passing through the first bore in the firearm mounting end of the tactical attachment adapter, engaging the threaded bore of said ammunition tube of the firearm through a clearance bore in the barrel retaining lug; and a tactical attachment breaching tool having a mounting structure fixed to a first end of a cylindrical tube, the mounting structure having a first portion and a second portion, the first portion having one or more "J" shaped slots fashioned within an outer surface, the first portion being inserted into the cavity fashioned within the tactical attachment adapter such that one or more pins extending into the cavity are engaged within a hook portion of the "J" shaped slots, the second portion of the mounting structure fixed to the first end of the cylindrical tube, a second end of the cylindrical tube having a pointed structure fashioned therein defined by an intersection of two planes, a line of intersection of the two planes being perpendicular to a longitudinal axis of the cylindrical tube, wherein the tactical attachment adapter has a second bore fashioned therein, extending from the first bore to the cavity, the second bore having a spring and a retaining plate inserted therein, the retaining plate having a first surface in contact with the outer surface of the first portion of the tactical attachment breaching tool mounting structure, the mounting plate having a second opposing surface in contact with the spring, the spring captured between said firearm mounting end of the tactical attachment adapter and the mounting plate.

It is another object of the present invention to provide a system for mounting a tactical attachment focused point breaching tool to a firearm having an ammunition tube and an ammunition spring mounted therein, containing a tactical attachment adapter having an ammunition tube mounting end and an opposing tactical attachment mounting end, said ammunition tube mounting end removably mounted to an end of the ammunition tube, the tactical attachment mounting end having a cavity fashioned therein having one or more pins extending into the cavity; and a tactical attachment breaching tool having a mounting structure fixed to a first end of a cylindrical tube, the mounting structure having a first portion and a second portion, said first portion having one or more "J" shaped slots fashioned within an outer surface, the first portion being inserted into the cavity fashioned within the tactical attachment adapter such that one or more pins extending into the cavity are engaged within a hook portion of the "J" shaped slots, the second portion of the mounting structure fixed to the first end of the cylindrical tube, a second end of said cylindrical tube having a pointed structure fashioned therein, defined by an intersection of two planes, the line of intersection of the two planes being perpendicular to a longitudinal axis of the cylindrical tube, wherein the tactical attachment adapter has a bore fashioned therein extending from the ammunition tube mounting end to the cavity, the bore having a piston inserted therein having a first surface in contact with the outer surface of the tactical attachment breaching tool mounting structure, the piston having a second opposing surface in contact with the ammunition spring.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF THE PREFERRED EMBODIMENTS

Example embodiments of the subsequently disclosed present invention provide significant improvements over the heretofore described prior art. The present invention discloses a system for a wide variety of tactical attachments that can be added to long guns with tube magazines or shotguns with tube magazines. The system provides a standardized mounting geometry for all tactical attachments that are mounted to custom adapters designed for each individual firearm. The adapters provide fast insert and lock mechanisms with an optional locking collar to prevent loosening of the tactical attachment. In some example embodiments, the locking ring is omitted. In other example embodiments, the magazine spring is fully contained by the adapter, even with the tactical attachment removed, so there is no possibility of loosing the spring or having to re-insert the spring during the swap of different attachments. A wide variety of tactical attachments are accommodated with this system, including (but not limited to) flashlights, laser illumination sights, door breaching tools, and magazine capacity extension tubes.

Figure 1:
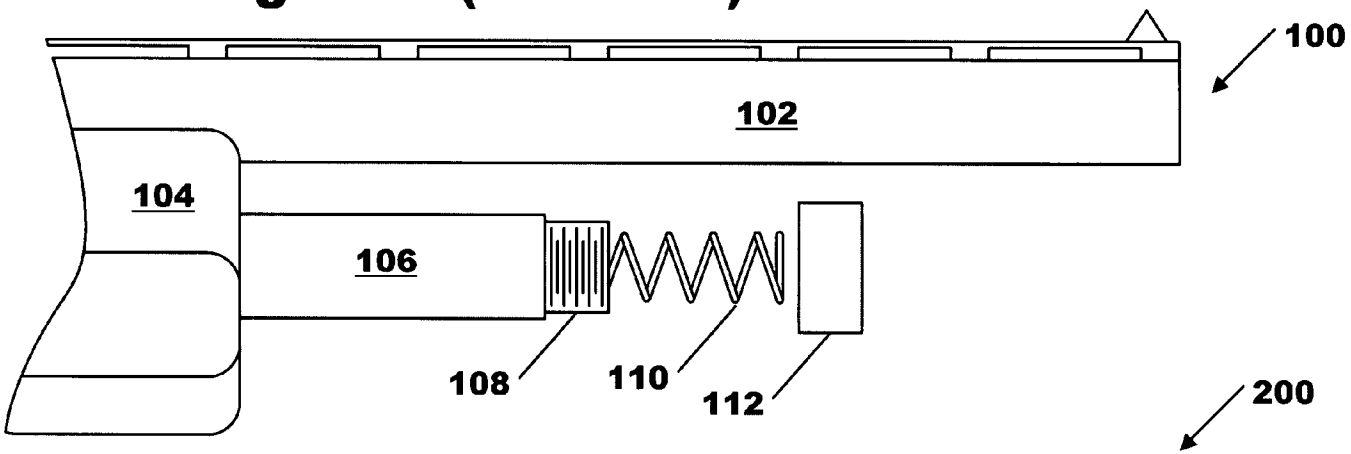
Figure 1 (Prior Art)
FIG. 1 (Prior Art) is a side view of a shotgun having an ammunition tube.
Figure 2:
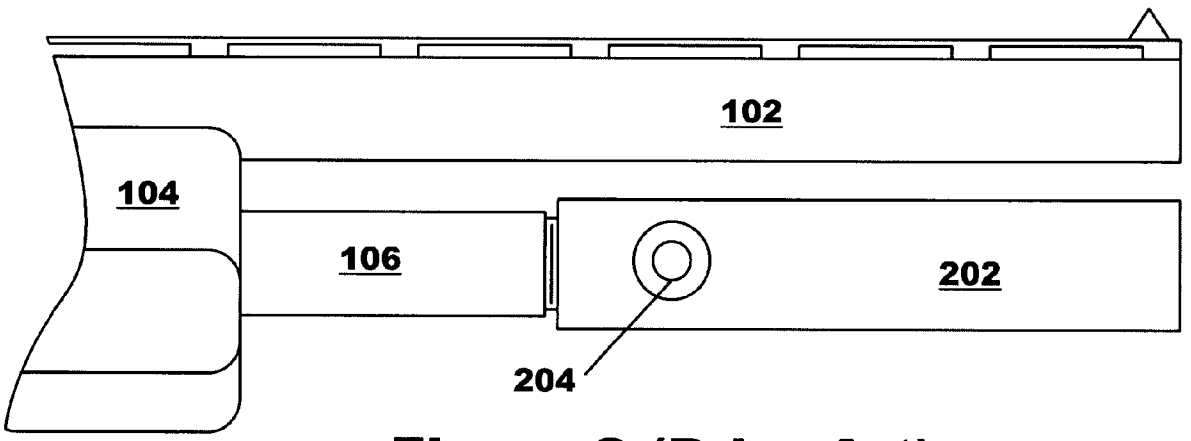
Figure 2 (Prior Art)
FIG. 2 (Prior Art) is a side view of a shotgun having a flashlight threaded on to the end of a magazine tube.
Figure 3:
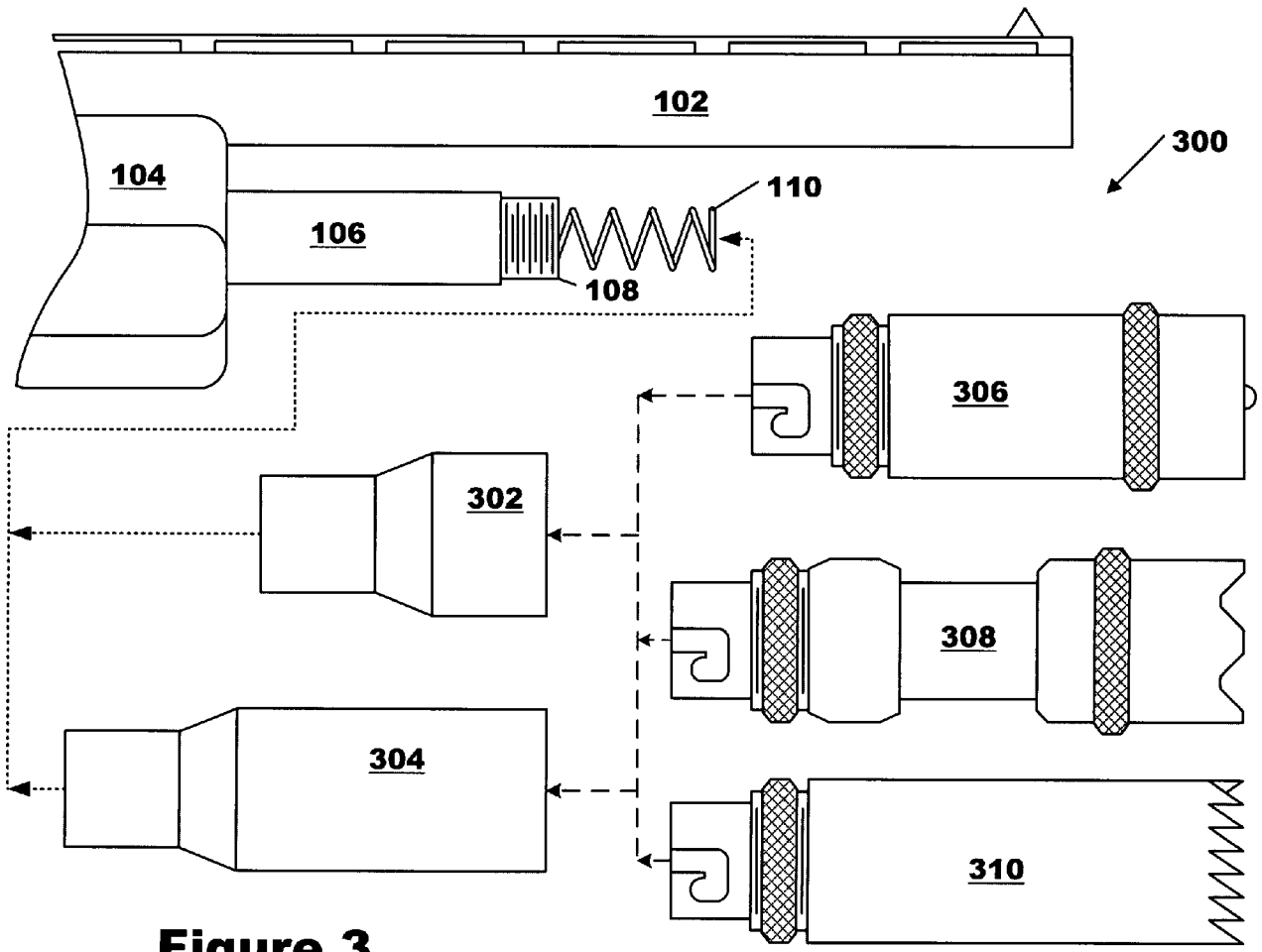
FIG. 3 is a profile side view of a tactical attachment system, in accordance with example embodiments of the present invention.

FIG. 3 is a profile side view 300 of a tactical attachment system, in accordance with example embodiments of the present invention. As an example, a pump style shotgun (as shown in FIG. 1) is used to illustrate the application of embodiments of the present invention, although it is understood that other suitable weapons having tube ammunition magazines may also be utilized, as can be appreciated by those skilled in the art. Adapters 302, 304 are threaded on to ammunition tube 106 via threads 108. The differences between adapters 302 and 304 are discussed further below. Tactical attachments laser illumination sight 306, flashlight 308, and breaching tool 310 all have a common mounting geometry, which is designed to interchangeably fit the receiving portion of adapters 302, 304. In the field or during use of the firearm, interchange of any of the tactical attachments 306, 308, or 310 can be accomplished without tools or the removal of adapter 302 (or 304). This flexibility allows the owner of the firearm to purchase and stock different adapters designed for individual weapons, but use a common selection of tactical attachments for all firearms. Significant cost savings can be realized, particularly for military organizations or large law enforcement departments, as the purchase of a large number of tactical attachments designed for individual weapons is no longer required.

Figure 4A:
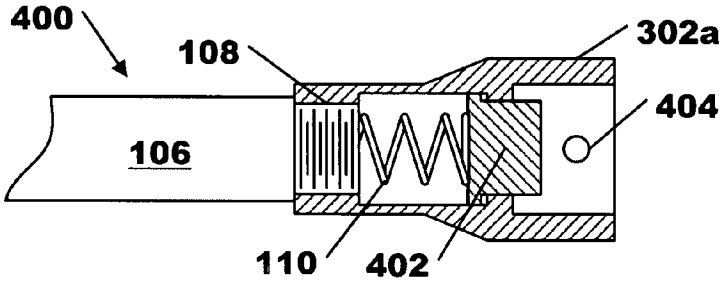
FIG. 4*a* is a partial cross section view of a tactical attachment adapter mounted on a magazine tube, in accordance with an example embodiment of the present invention.

FIGS. 4*a*-4*d* disclose details of adapter 302. FIG. 4*a* is a partial cross section view 400 of a tactical attachment adapter 302*a* mounted on a shotgun magazine tube 106, in accordance with an example embodiment of the present invention. In this example version 302*a* of adapter 302, ammunition spring 110 is contained by piston 402, which provides containment of the spring 110 once the adapter 302*a* is threaded onto the magazine tube 106. Piston 402 is freely mounted within the bore of adapter 302*a*, allowing the spring force to be transmitted to any tactical attachment coupled to the adapter (see FIG. 4*b*). Adapter 302*a* has pins 404 designed to engage fabricated slots in the mounting adapter portion of a tactical attachment (see also FIG. 4*b*). Adapter 302*a* is designed to be permanently mounted to the ammunition tube 106, serving the purpose of cap 112, allowing full functionality of the weapon, with or without tactical attachments connected.

Figure 4B:
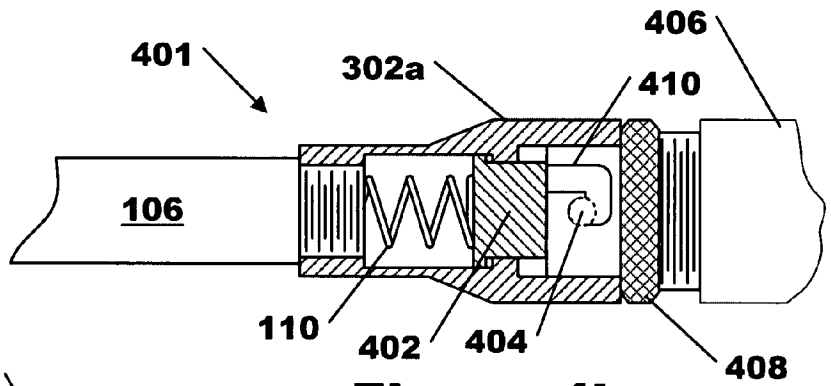
FIG. 4*b* is a partial cross section view of a tactical attachment adapter mounted on a magazine tube, and mounted to a typical tactical attachment, in accordance with an example embodiment of the present invention.

FIG. 4*b* is a partial cross section view 401 of a tactical attachment adapter 302*a* mounted on a magazine tube 106, mounted to an example tactical attachment mating structure 406, in accordance with an example embodiment of the present invention. The mating portion of a typical example tactical attachment 406 has a fabricated slot 410 designed to engage pins 404 of adapter 302*a*. Slot 410 is generally fabricated in the shape of a squared off "J", with an entrance section (the leg of the "J") and a re-entrant pin locking section (the "hook" on the "J"). When mating a tactical attachment 406 to the adapter 302*a*, the tactical attachment 406 is oriented so the pins 404 engage the entrance section of slot(s) 410. The tactical attachment 406 is then pushed in to the mounting cavity of adapter 320*a* until the rear mounting surface of the tactical attachment 406 contacts piston 402. Further insertion of tactical attachment 406 compresses spring 110 via rearward movement of piston 402, until pins 404 contact the base of the "J". Tactical attachment 406 is then rotated until pins 404 are aligned with the re-entrant pin locking section, then released. The slight forward motion of the tactical attachment 406 is aided by compressed spring 110 and piston 402 until pins 404 are locked in the hook portion of slot 410. Locking collar 408 is back threaded against the front face of adapter 302 once pins 404 are properly captured by the re-entrant geometry of slot 410. Optionally, locking collar 408 may be omitted for some tactical attachments.

The aforementioned discussion describes an example embodiment whereby pins are mounted in the tactical attachment adapter which engage slots machined in each tactical attachment. As can be appreciated by those skilled in the art, an example embodiment wherein the pins are mounted to the outer surface of each tactical attachment and the slots machined within the inner surface of the tactical attachment adapter may also be realized (not shown).

Figure 4C:
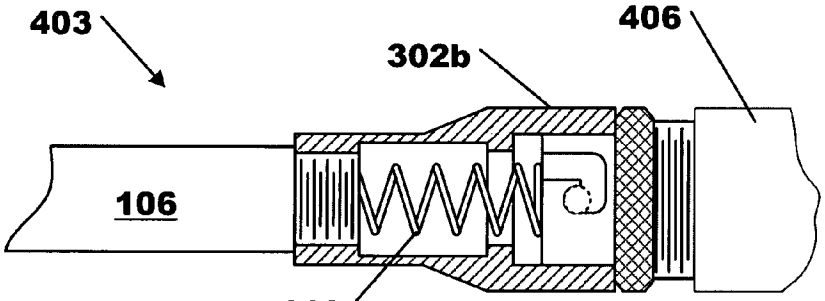
FIG. 4*c* is a partial cross section view of a "bore through" version of the tactical attachment adapter, in accordance with an example embodiment of the present invention.
Figure 4D:
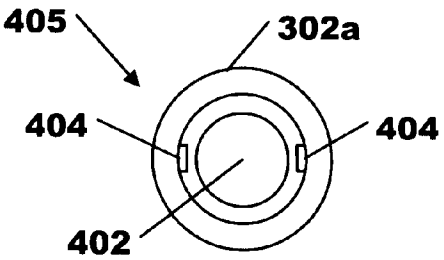
FIG. 4*d* is an end view of the tactical attachment adapter of FIG. 4*a*, in accordance with an example embodiment of the present invention.

FIG. 4*c* is a partial cross section view 403 of a "bore through" version 302*b* of the tactical attachment adapter, in accordance with an example embodiment of the present invention. In this example version, piston 402 is removed, allowing spring 110 to be directly engaged against the rear mounting surface of tactical attachment 406. This example embodiment is useful for extending magazine ammunition capacity, but has the potential disadvantage of exposing the open end of the spring while changing tactical attachments. FIG. 4*d* is an end view 405 of the tactical attachment adapter 302*a* of FIG. 4*a*, in accordance with an example embodiment of the present invention. In this view the two diametrically opposed engagement pins 404 are indicated, which mate with corresponding diametrically opposed fabricated slots on the coupling portion of the tactical attachments 406 (not shown). In the example embodiment of FIGS. 4*a*-4*d*, two engagement pins 404 are provided on the adapter. However, as can be appreciated by those skilled in the art, only one pin is essential for operation. Likewise, only a single slot 410 required on each tactical attachment, although having two slots diametrically opposed aids in rapid engagement of the attachments as there are two possible engagement positions, as opposed to only one.

Figures 5A, 5B, 5C, 5D:
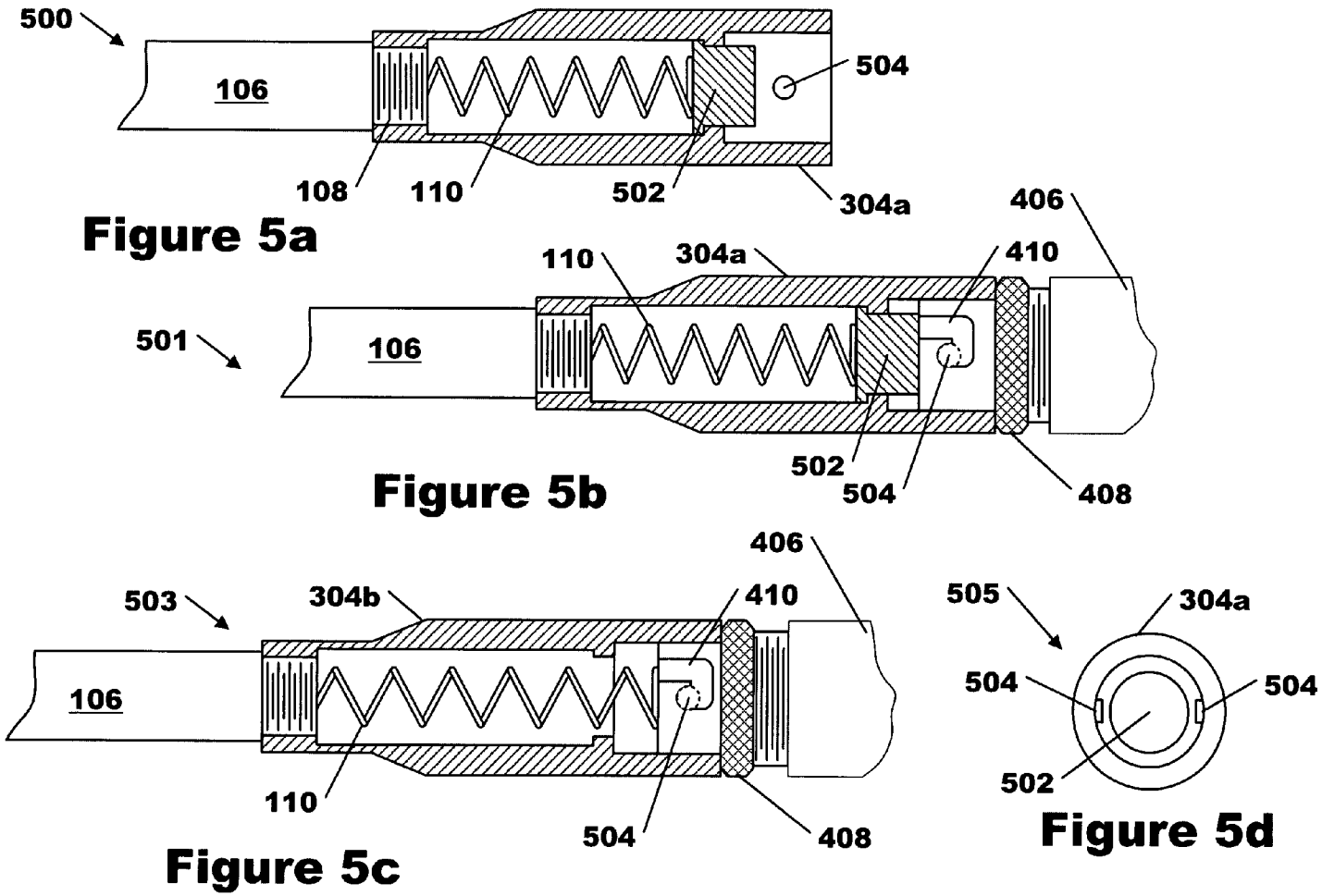
FIG. 5*a* is a partial cross section view of an extended length tactical attachment adapter mounted on a magazine tube, in accordance with an example embodiment of the present invention.
FIG. 5*b* is a partial cross section view of an extended length tactical attachment adapter mounted on a magazine tube, and mounted to a typical tactical attachment, in accordance with an example embodiment of the present invention.
FIG. 5*c* is a partial cross section view of a "bore through" version of the extended length tactical attachment adapter, in accordance with an example embodiment of the present invention.
FIG. 5*d* is an end view of the extended length tactical attachment adapter of FIG. 5*a*, in accordance with an example embodiment of the present invention.

FIGS. 5*a*-5*d* disclose details of adapter 304. FIG. 5*a* is a partial cross section view 500 of an extended length tactical attachment adapter 304 mounted on a magazine tube 106, in accordance with an example embodiment of the present invention. The difference between adapters 302 and 304 is that adapter 304 allows for further expansion of the ammunition spring 110, by extending the dimension between the end of the ammunition tube 106 and the rear of piston 502, over that provided by adapter 302. This extended length allows for more ammunition to be stored within the ammunition tube. Adapter 304*a* provides for extended ammunition capacity without the need for separate ammunition tubes (which would prohibit the use of other tactical attachments) or a bore through adapter (which can make changing tactical attachments more difficult due to the exposed magazine spring). Piston 502 and pins 504 serve the same purpose as previously described for piston 402 and pins 404 in FIGS. 4*a*-4*d*.

FIG. 5*b* is a partial cross section view 501 of an extended length tactical attachment adapter 304*a* mounted on a magazine tube 106, mounted to an example tactical attachment mating structure 406, in accordance with an example embodiment of the present invention. FIG. 5*c* is a partial cross section view 503 of a "bore through" version 304*b* of the extended length tactical attachment adapter, in accordance with an example embodiment of the present invention. FIG. 5*d* is an end view 505 of the extended length tactical attachment adapter 304*a* of FIG. 5*a*, in accordance with an example embodiment of the present invention.

Figure 6:
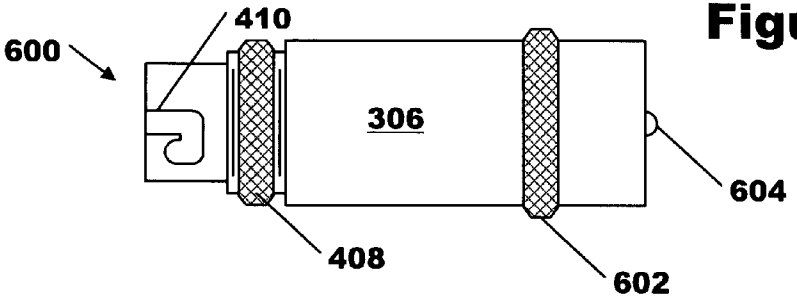
FIG. 6 is a side view of a laser sight tactical attachment, in accordance with an example embodiment of the present invention.

FIG. 6 is a side view 600 of a laser illumination sight tactical attachment 306, in accordance with an example embodiment of the present invention. This sight produces a narrow beam of visible red or infrared light, projecting an illuminated "dot" at the intended aim point of the weapon it's mounted on. Typically, the light source is a solid state laser diode 604. To be used effectively, the laser illumination sight 306 must be mounted securely on the weapon, and must remain in alignment during handling and recoil after discharge. Mounting the laser sight coaxial with the ammunition tube assures alignment with the sight axis of the firearm. The slight displacement from the actual axis of the barrel is a minor issue when used with shotguns, and can be easily compensated for on a long gun. The mating end of laser sight 306 has the fabricated slot 410 required for compatible mounting with pins 404,504 in adapter 302 or 304. Knurled ring 408 is back threaded against the adapter body once the pins 404,504 are engaged within slot 410, holding the laser sight 306 firmly on the weapon. Optionally, ring 408 may be omitted without loss of functionality. Turning the laser on and off is accomplished with a rotary actuated switch 602. This switch provides tactile feedback with detents to confirm the "on" status of the laser. In one example embodiment, the laser illumination sight 306 is powered with batteries that are contained within the enclosure (not shown). As would be evident to those skilled in the art, the laser illumination sight can be used whether mounted to a tactical attachment adapter or not.

Figure 7:
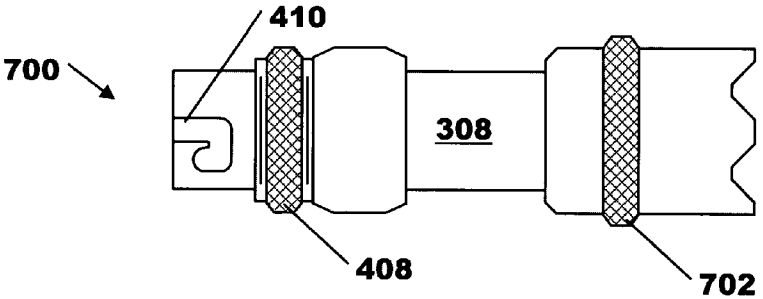
FIG. 7 is a side view of a flashlight tactical attachment, in accordance with an example embodiment of the present invention.

FIG. 7 is a side view 700 of a flashlight tactical attachment 308, in accordance with an example embodiment of the present invention. Flashlight 306 is equipped with the same mounting structure as shown for the laser illumination sight 306. Flashlight 306 may use LEDs (either visible or infrared) or incandescent bulbs to provide illumination. A rotary actuated switch 702 is also provided on the flashlight, which allows the operator to operate the flashlight without removing their eyes from the sight picture ahead of the weapon. In one example embodiment, the flashlight 308 is powered with batteries that are contained within the enclosure (not shown). As would be evident to those skilled in the art, the flashlight can be used whether mounted to a tactical attachment adapter or not.

Figure 8:
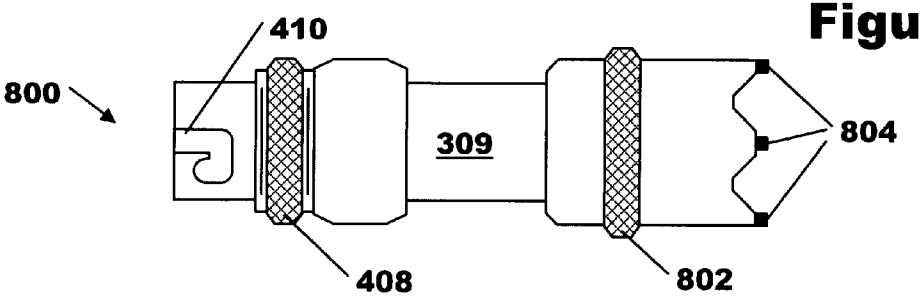
FIG. 8 is a side view of a flashlight tactical attachment, having stun gun electrodes, in accordance with an example embodiment of the present invention.

FIG. 8 is a side view 800 of a flashlight tactical attachment 309, having stun gun electrodes 804, in accordance with an example embodiment of the present invention. The built in stun electrodes provide a non-lethal option for disabling subjects. This is accomplished by providing a very high voltage, low current electrical discharge at electrodes 804. Rotary switch 802 provides control of both lighting and stun functions. In one example embodiment, the flashlight 309 is powered with batteries that are contained within the enclosure (not shown). As would be evident to those skilled in the art, the flashlight and stun functions can be used whether mounted to a tactical attachment adapter or not.

Figure 9A:
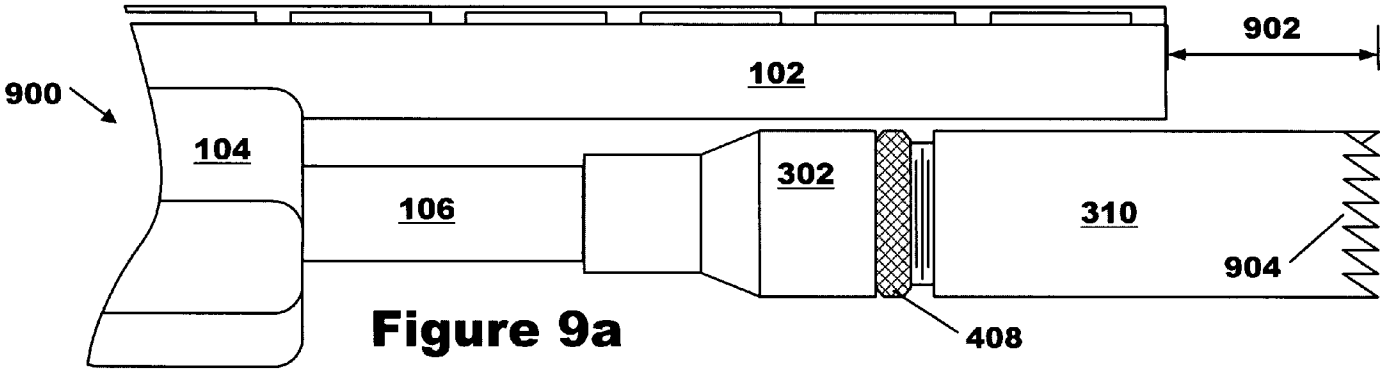
FIG. 9*a* is a side view of a shotgun having a tactical attachment adapter and a breaching tool tactical attachment mounted, in accordance with an example embodiment of the present invention.

FIGS. 9*a,b,c* disclose details of an example breaching attachment of the present invention. A breaching tool is typically an extension placed at the muzzle end of shotguns, with a saw-toothed end protruding beyond the end of the muzzle. The jagged edge is placed firmly against a surface and the shotgun is discharged. This tool is primarily used by military and law enforcement personnel to blow out locks and door hinges to allow forced entry to buildings and enclosed rooms. FIG. 9*a* is a side view 900 of a shotgun having a tactical attachment adapter 302 and a breaching tool tactical attachment 310 mounted, in accordance with an example embodiment of the present invention. Breaching tool 310 is generally cylindrically shaped, having a jagged toothed end structure, which must protrude beyond the end of the barrel 102 by a distance 902. The teeth 904 fashioned into the end of breaching tool 310 are designed to firmly dig into the surface close to where the projectiles from the firearm will be discharged, to hold the muzzle firmly in place during discharge, and focus the destructive force. Use of the breaching tool requires firm mounting to the shotgun which is aided by locking ring 408, particularly during discharge and recoil of large 10 and 12 gauge shotguns.

Figure 9B:
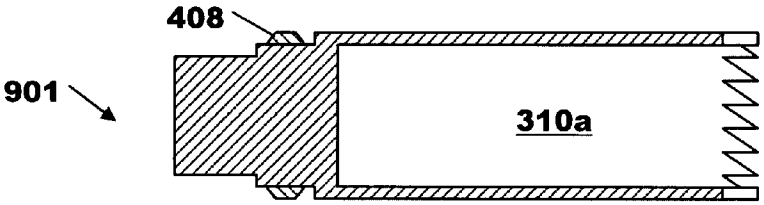
FIG. 9*b* is a cross section view of a breaching tactical attachment, in accordance with an example embodiment of the present invention.

FIG. 9*b* is a cross section view 901 of a breaching tactical attachment 310*a*, in accordance with an example embodiment of the present invention. This embodiment provides for the standard breaching tactical attachment. Note that this breaching attachment 310*a* can be rapidly exchanged with any of the foregoing tactical attachments without worry of the magazine spring being dislodged during the exchange, when used with adapters 302*a* or 304*a*. Rapid exchange with for example, the flashlight 308, can be useful to military or law enforcement personnel who, subsequent to breaching doors, must proceed into darkened rooms.

Figure 9C:
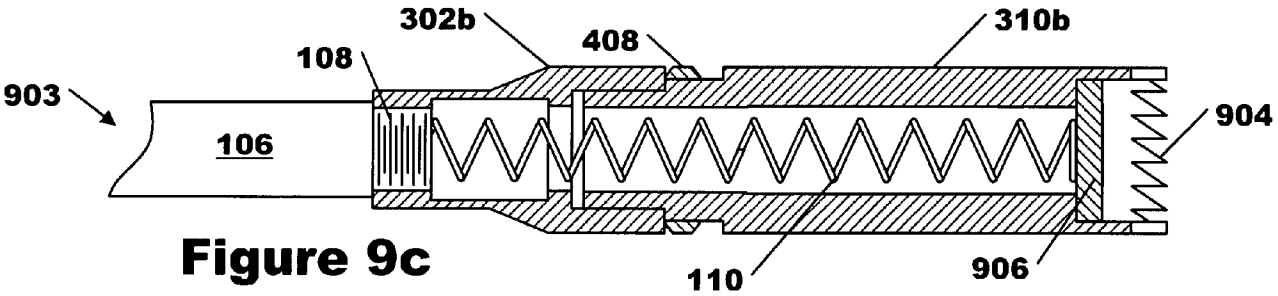
FIG. 9*c* is a partial cross section view of a "bore through" version of a breaching tactical attachment, in accordance with an example embodiment of the present invention.

FIG. 9*c* is a partial cross section view 903 of a "bore through" version of a breaching tactical attachment 310*b*, in accordance with an example embodiment of the present invention. The bore through version 310*b* provides for increased magazine capacity by allowing the magazine spring 110 to extend the majority of the length of the breaching tool. A shallow plug 906 is inserted from the toothed end of the breaching attachment to provide a stop for spring 110.

Figure 10A:
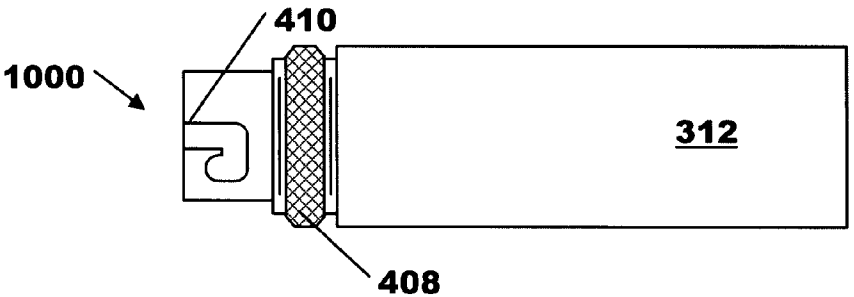
FIG. 10*a* is a side view of a magazine capacity extension tube tactical attachment, in accordance with an example embodiment of the present invention.
Figure 10B:
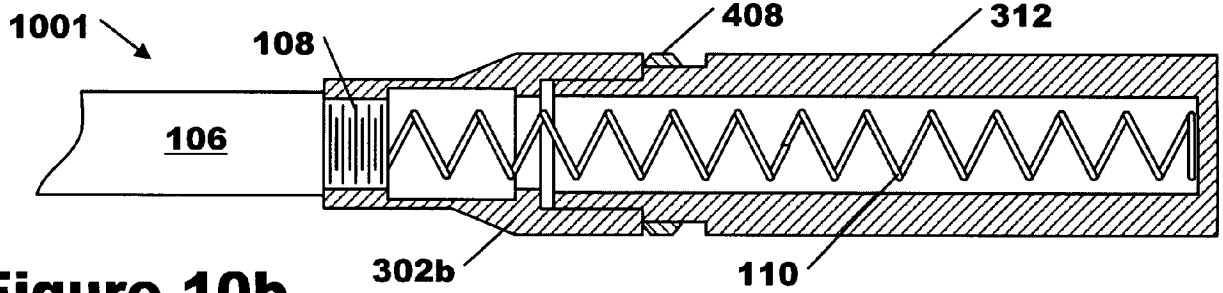
FIG. 10*b* is a partial cross section view of a magazine capacity extension tube tactical attachment, in accordance with an example embodiment of the present invention.

FIG. 10*a* is a side view 1000 of a magazine capacity extension tube tactical attachment 312, in accordance with an example embodiment of the present invention. The magazine extension tube provides increased ammunition capacity by extending the volume of the ammunition tube 106. A cross section view 1001 is shown in FIG. 10*b*. The magazine capacity extension tube must be used with bore through adapters to obtain an increase in ammunition capacity, so swapping with other tactical attachments requires the compression of the magazine spring during the exchange.

Figure 11:
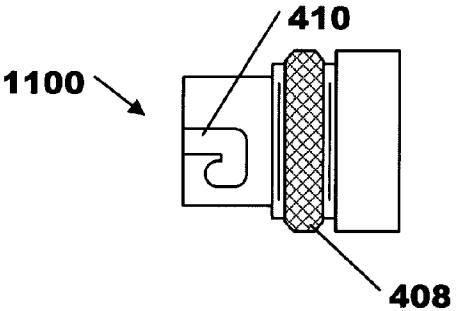
FIG. 11 is a side view of a tactical attachment cap, in accordance with an example embodiment of the present invention.

FIG. 11 is a side view 1100 of a tactical attachment cap, in accordance with an example embodiment of the present invention. The cap may be useful for enclosing the open end of adapters 302*a* and 304*a* when no tactical attachments are mounted, to prevent the contamination of the piston mechanism with dirt and debris. The cap is required to seal bore through type adapters and provide an engagement surface for the magazine spring, when no tactical attachments are mounted.

Figure 12:
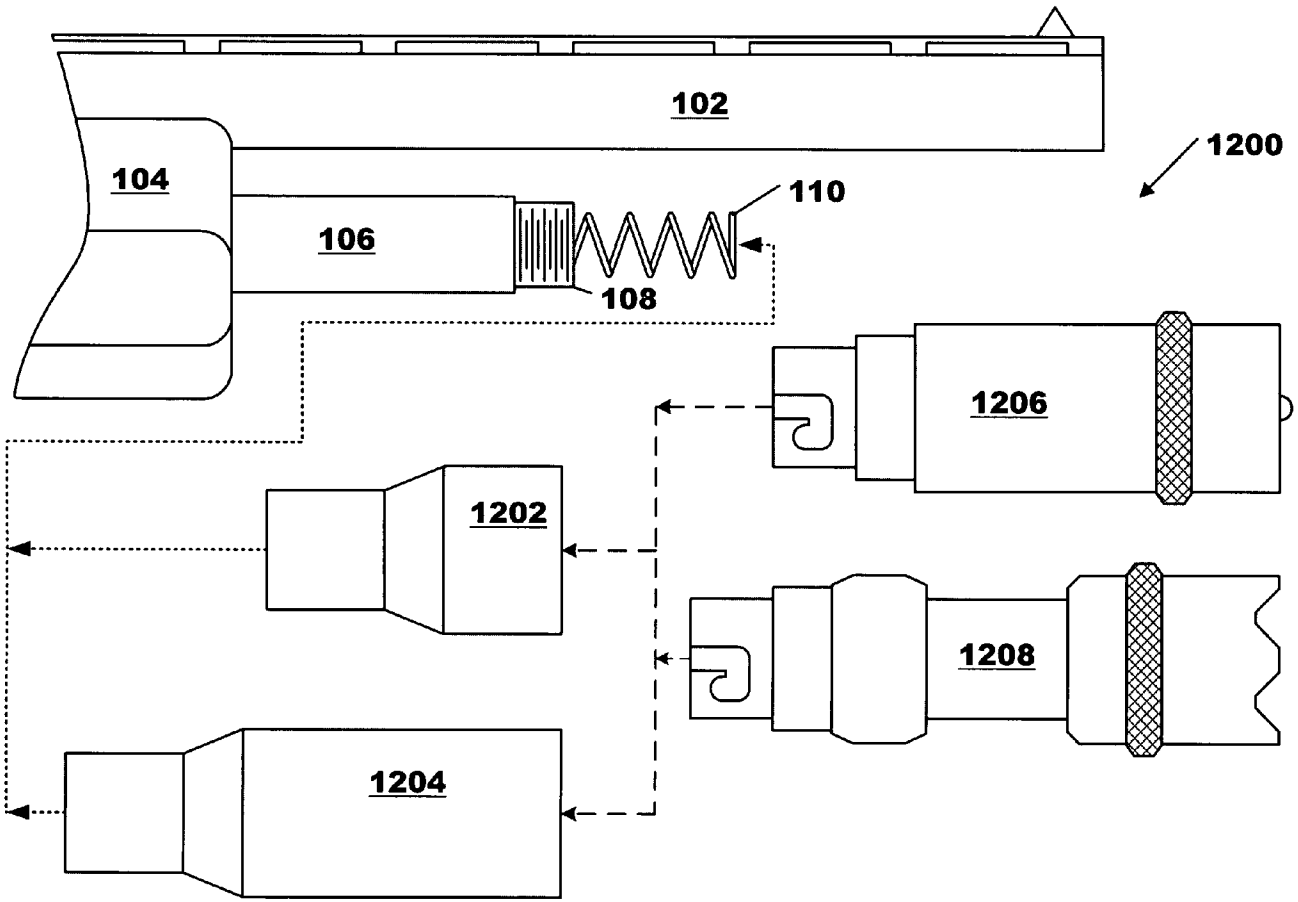
FIG. 12 is a profile side view of a tactical attachment system without locking rings, in accordance with example embodiments of the present invention.

FIG. 12 is a profile side view 1200 of a tactical attachment system without locking rings, in accordance with example embodiments of the present invention. Adapters 1202 and 1204 are basically the same as adapters of FIGS. 4*a* and 5*a*, as they are designed to be used with tactical adapters with or without locking rings. While locking rings 408 are useful for assuring a tactical attachment will not come off its adapter, a number of tactical attachments can be used without the locking ring, particularly if the magazine spring 110 is stiff enough to provide suitable force against piston 402. Not having a locking ring may also speed up the removal and re-attachment of tactical adapters, such as laser sight 1206 and flashlight 1208.

Figure 13A:
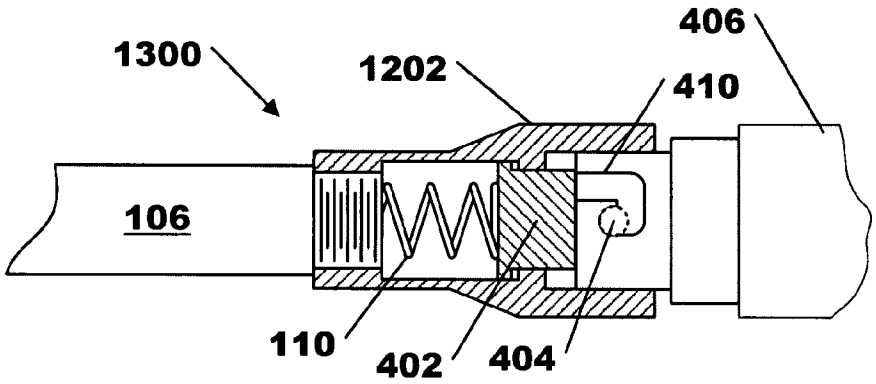
FIG. 13*a* is a partial cross section view of a tactical attachment adapter mounted on a magazine tube, and mounted to a tactical attachment without locking ring, in accordance with an example embodiment of the present invention.

FIG. 13*a* is a partial cross section view 1300 of a tactical attachment adapter mounted on a magazine tube, and mounted to a tactical attachment 406 without locking ring, in accordance with an example embodiment of the present invention.

Figure 13B:
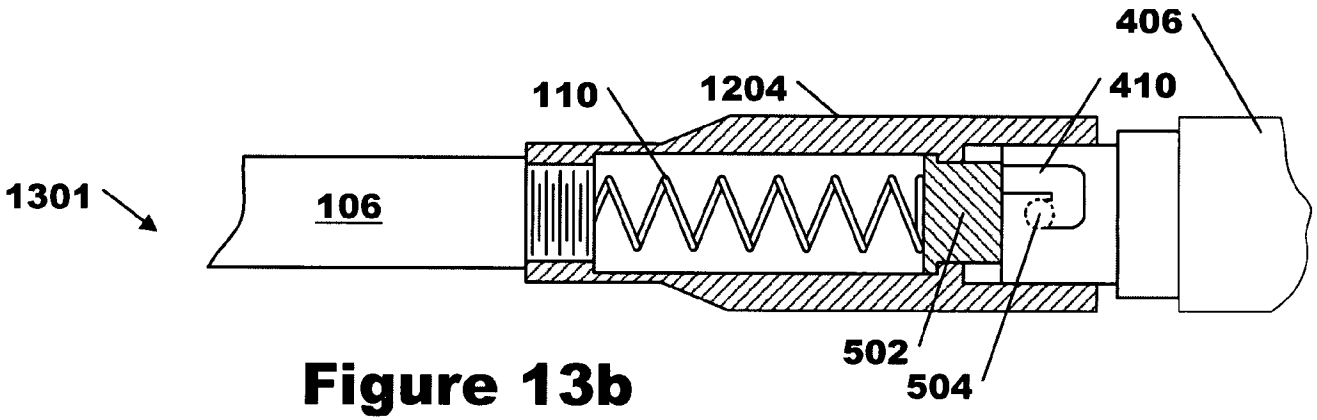
FIG. 13*b* is a partial cross section view of an extended length tactical attachment adapter mounted on a magazine tube, and mounted to a typical tactical attachment without locking ring, in accordance with an example embodiment of the present invention.

FIG. 13*b* is a partial cross section view 1301 of an extended length tactical attachment adapter 1204 mounted on a magazine tube, and mounted to a typical tactical attachment 406 without locking ring, in accordance with an example embodiment of the present invention.

Figure 14:
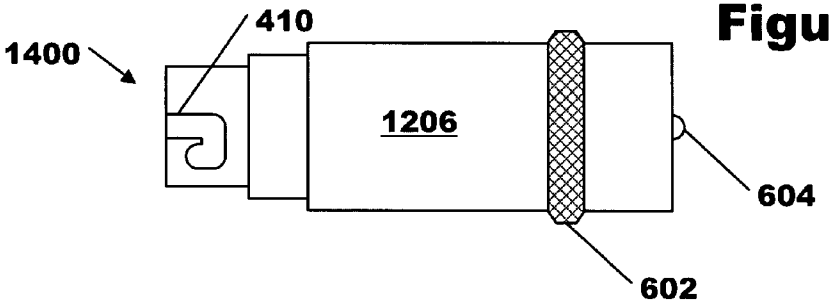
FIG. 14 is a side view of a laser sight tactical attachment without locking ring, in accordance with an example embodiment of the present invention.

FIG. 14 is a side view 1400 of a laser sight tactical attachment 1206 without locking ring, in accordance with an example embodiment of the present invention.

Figure 15:
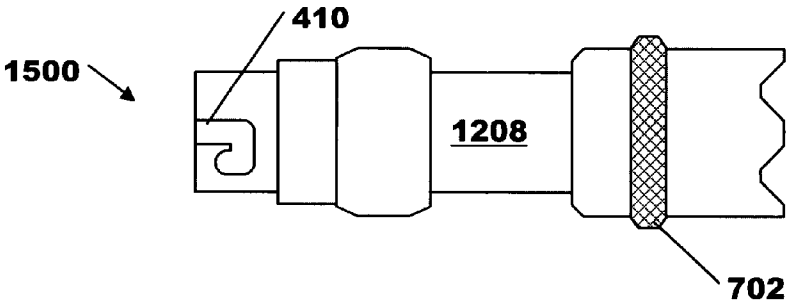
FIG. 15 is a side view of a flashlight tactical attachment without locking ring, in accordance with an example embodiment of the present invention.

FIG. 15 is a side view 1500 of a flashlight tactical attachment 1208 without locking ring, in accordance with an example embodiment of the present invention.

Figure 16:
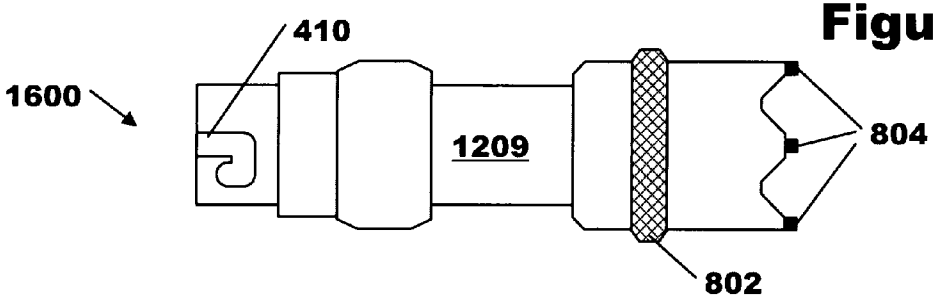
FIG. 16 is a side view of a flashlight tactical attachment without locking ring, having stun gun electrodes, in accordance with an example embodiment of the present invention.

FIG. 16 is a side view 1600 of a flashlight tactical attachment 1209 without locking ring, having stun gun electrodes, in accordance with an example embodiment of the present invention.

Figure 17A:
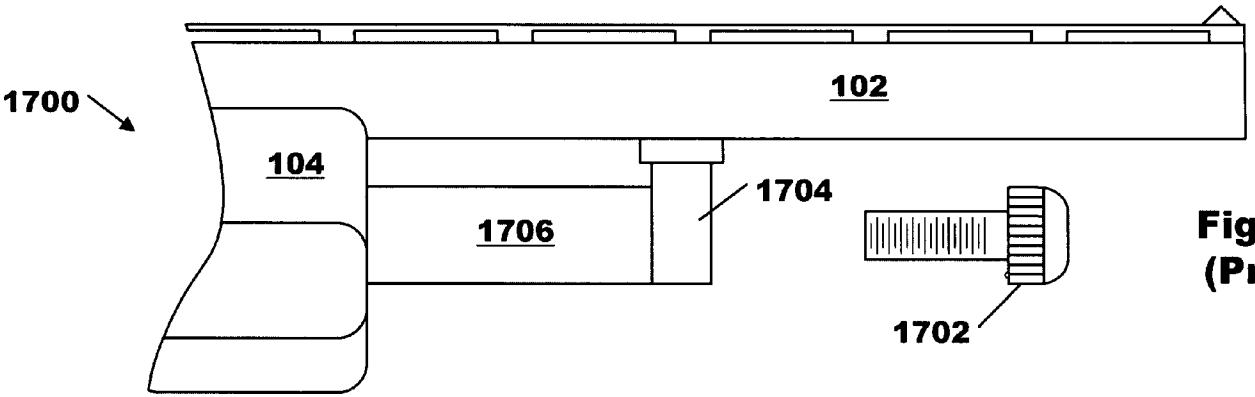
Figure 17a (Prior Art)
FIG. 17*a* (Prior Art) is a side view of a shotgun having a barrel retaining screw that threads into the ammunition tube.
Figure 17C:
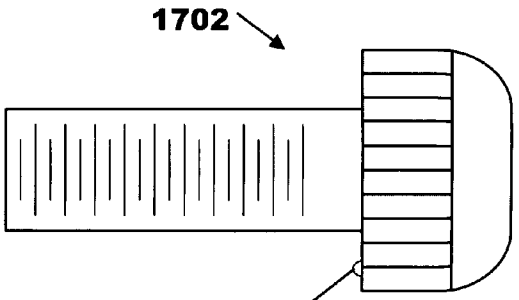
Figure 17c (Prior Art)
FIG. 17*c* (Prior Art) is a side view of the barrel retaining screw 1702.
Figure 17B:
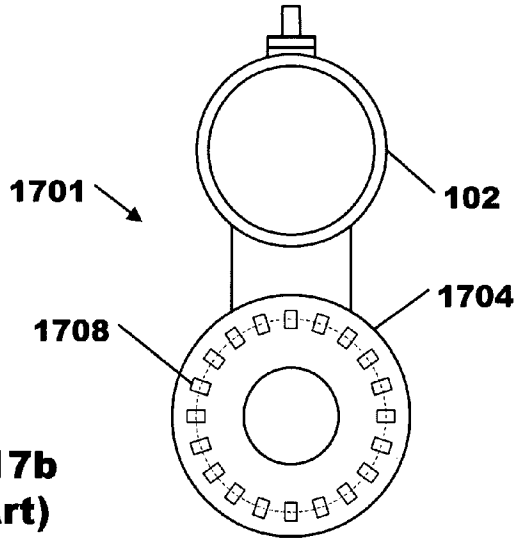
Figure 17b (Prior Art)
FIG. 17*b* (Prior Art) is an end view of the barrel retaining lug 1704.

FIG. 17*a* (Prior Art) is a side view 1700 of a shotgun having a barrel retaining screw 1702 that threads into the ammunition tube. This type of shotgun (of FIG. 17*a*) is distinguished from those of FIG. 1 in that mechanical attachment to the ammunition tube 1706 is via a barrel retaining screw 1702 that has a male machine threaded member that engages with a female threaded bore (not shown) in the ammunition tube 1706. Another distinguishing factor is that barrel retaining screw 1702 engages a barrel retaining lug 1704. Lug 1704 is rigidly fixed to barrel 102 and aids in holding the barrel in position after retaining device 1702 is threaded into the ammunition tube. FIG. 17*b* (Prior Art) is an end view of the barrel retaining lug 1704. In the surface of retaining lug are 20 machined cavities 1708. These engage with a spring loaded ball detent device fashioned in the retaining screw 1702 to prevent loosening of the screw once tightened in position against lug 1704. FIG. 17*c* (Prior Art) is a side view of the barrel retaining screw 1702 having a ball detent device 1710. Shotguns shown in FIGS. 17*a,b,c* are produced, for example, by O.F. Mossberg and Sons, Inc., of North Haven Conn.

Due to the considerable differences between the shotguns shown in FIGS. 1 (prior art, hereinafter type 1 firearms) and 17 (prior art, hereinafter type 2 firearms), tactical attachment adapters previously described for type 1 firearms will not fit type 2 shotguns. Due to the popularity of type 2 firearms, it is likely that a firearms owner may have shotguns of both types, and any such owner that invests in tactical attachment adapters and tactical attachments for the first type will want to use their inventory of tactical attachments (and tactical attachment adapters if possible) with type 2 firearms.

Figure 18A:
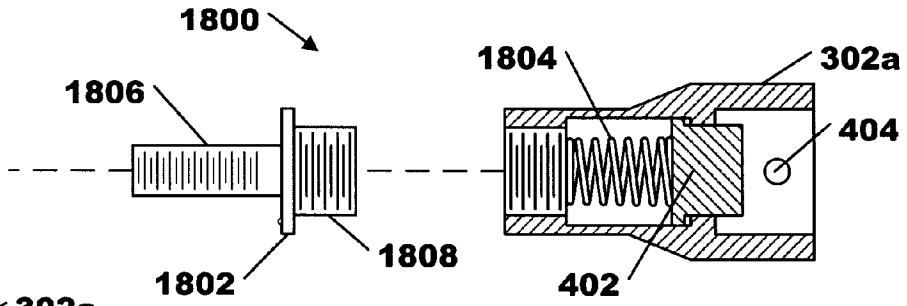
FIG. 18*a* is a partial cross section view of a conversion adapter to enable the mounting of tactical attachment adapters to shotguns of FIGS. 17*a,b,c* in accordance with an example embodiment of the present invention.

FIG. 18*a* is a partial cross section view 1800 of a conversion adapter 1802 to enable the mounting of tactical attachment adapters to type 2 shotguns of FIGS. 17*a,b,c* (prior art) in accordance with an example embodiment of the present invention. Conversion adapter 1802 has two opposing threaded members. One threaded member is fashioned with a male machine thread 1806 similar to that on barrel retaining screw 1702. An opposing threaded member 1808 has a male machine thread designed to engage the female threaded portion of example tactical attachment adapter 302*a*. Spring 1804 may also be supplied to load piston 402, required to back load any tactical attachment (not shown) mounted to example adapter 302*a*. Although tactical attachment adapter 302*a* is illustrated in FIG. 18*a*, it will be evident to those of ordinary skill in the art that adapters 304*a*, 1202, and 1204 may also be used interchangeably. Alternatively, spring 1804 can be fixed to the end of adapter 1802 (not shown) by crimping, welding, gluing, or other suitable method well known to those skilled in the art. This would allow tactical attachment adapters 302*b* and 304*b* to be used as well.

Figure 18C:
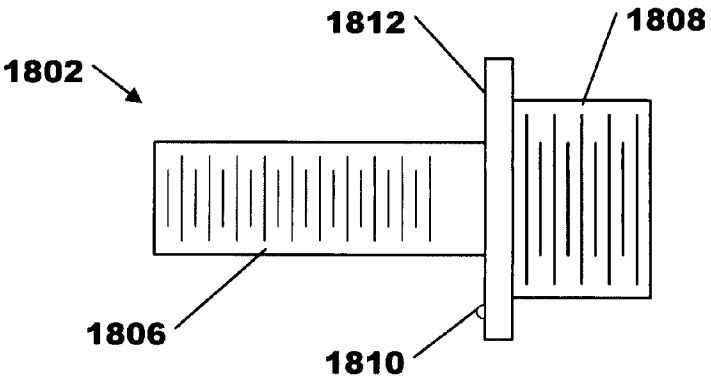
FIG. 18*c* is a side view of conversion adapter 1802 having a ball detent device in accordance with an example embodiment of the present invention.
Figure 18B:
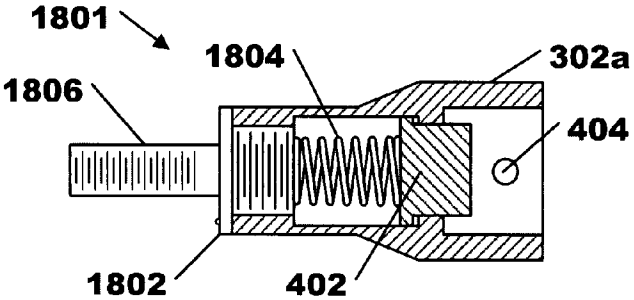
FIG. 18*b* is a partial cross section view of the conversion adapter 1802 mounted on a tactical attachment adapter 302 in accordance with an example embodiment of the present invention.

FIG. 18*b* is a partial cross section view 1801 of the conversion adapter 1802 mounted on a tactical attachment adapter 302*a* in accordance with an example embodiment of the present invention. Conversion adapter 1802 is threaded into the female threaded portion of tactical attachment adapter 302*a*, fully capturing spring 1804, which applies tension against piston 402. The female thread specifications of tactical attachment adapter 302*a* are dependent on the specific make and model of the type 1 firearm it was designed for. Therefore a plurality of conversion adapters 1802 may be manufactured to match the variety of type 1 firearms in service. However, even though a user may have multiple type 1 tactical attachment adapters 302 for different type 1 firearms, the user need only have one conversion adapter 1802 to convert a single tactical attachment adapter to a single type 2 firearm usage, since all tactical attachments will fit any tactical attachment adapter. This flexibility reduces the complex and expensive inventory required to outfit a military or law enforcement organization with tactical attachments for their assortment of type 1 and type 2 firearms. Conversion adapter 1802, coupled to tactical attachment adapter, then allows all previously described tactical attachments 306, 308, 309, 310*a*, 1206, 1208, 1209, and any future tactical attachment with the standardized "J" slot machined into the tactical attachment mounting portion as shown in FIGS. 4*b*, 4*c*, and 13*a*, to be used with type 2 firearms. Tactical attachments with and without locking rings 408 may be used interchangeably.

FIG. 18*c* is a side view of conversion adapter 1802 having a ball detent device 1810 in accordance with an example embodiment of the present invention. The ball detent device 1810 engages with machined cavities 1708 on the surface of barrel retaining lug 1704 of type 2 firearms (see FIGS. 17*a,b*, prior art) and prevents loosening of the conversion adapter 1802/tactical attachment adapter 302 assembly once tightened. Ball detent device 1810 is fabricated within adapter 1802 (see for example FIG. 20) to extend through retaining mounting surface 1812.

Figure 19:
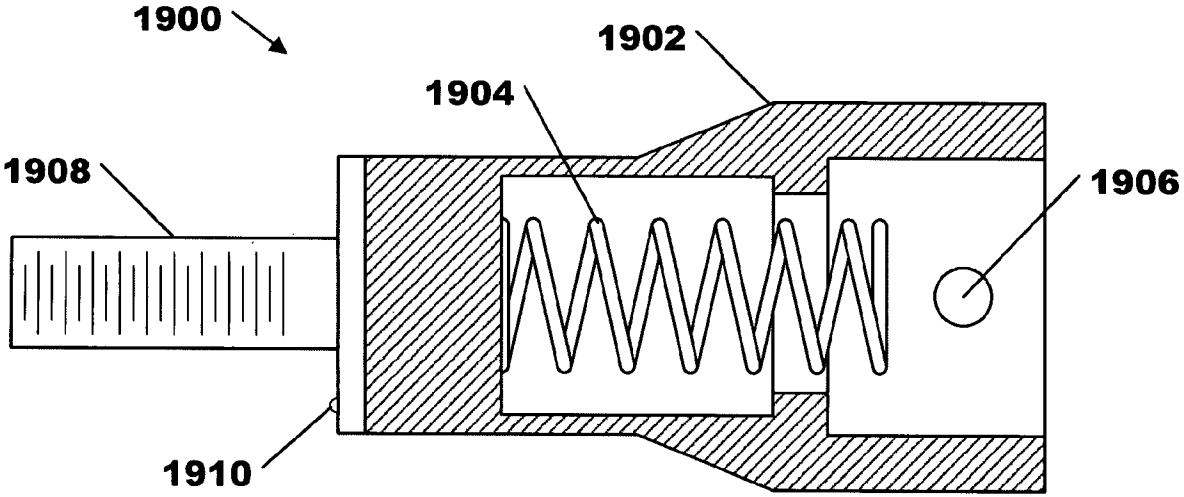
FIG. 19 is a partial cross section view of a tactical attachment adapter specifically fabricated for firearms of FIGS. 17*a,b,c* in accordance with an example embodiment of the present invention.

FIG. 19 is a partial cross section view 1900 of a tactical attachment adapter 1902 specifically fabricated for type 2 firearms of FIGS. 17*a,b,c* in accordance with an example embodiment of the present invention. In this example embodiment, threaded member 1908 is machined to engage the threaded bore in the ammunition tube of type two firearms, in a manner similar to machined member 1806. Member 1908 is rigidly fixed to adapter body 1902 and not removable. Spring 1904 is fixed to adapter body 1902 via welding, gluing, crimping, or any suitable method (not shown). Spring 1904 engages with the mounting end of any of the plurality of tactical attachments previously described (not shown), providing the bias force to lock the tactical attachment in place via the "J" shaped channel in each tactical attachment and pins 1906 (not shown). A spring detent device 1910 is also provided to properly engage with cavities in barrel retaining lug 1704 as previously described.

Figure 20:
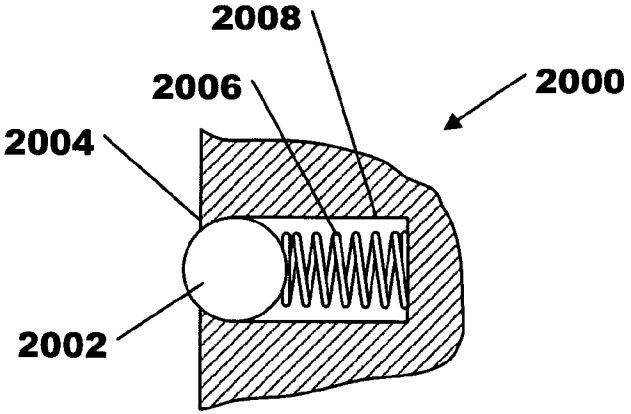
FIG. 20 is a partial cross section view of a ball detent device in accordance with an example embodiment of the present invention.

FIG. 20 is a partial cross section view 2000 of a ball detent device in accordance with an example embodiment of the present invention. This embodiment is exemplary of previously cited detent devices 1810 and 1910. A spring 2006 loaded ball 2004 is placed within a bore 2008. Ball 2004 is retained within the bore by crimping the edge of bore 2008 at the surface 2004.

Figure 21A:
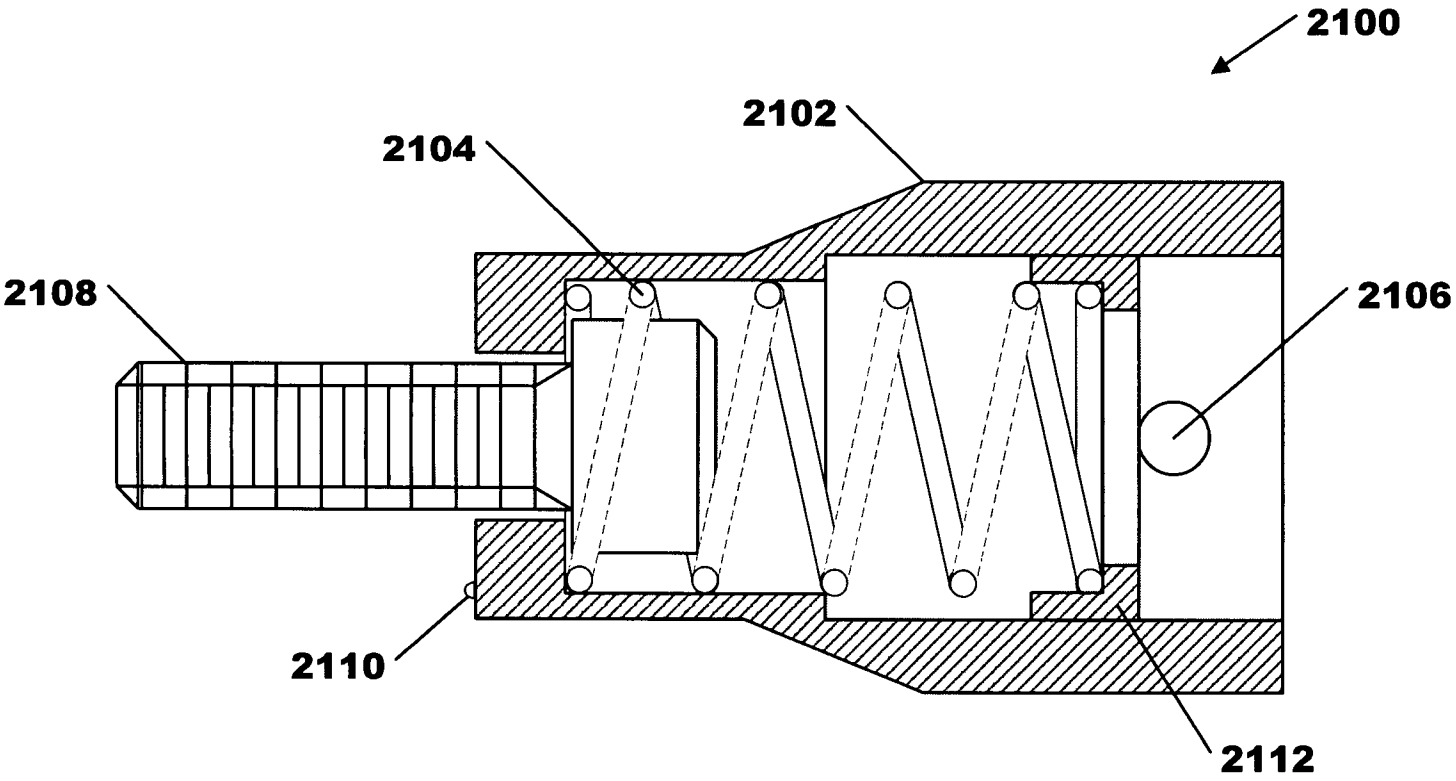
FIGS. 21*a,b* are partial cross section views of another tactical attachment adapter specifically fabricated for firearms of FIGS. 17*a,b,c* in accordance with example embodiments of the present invention.

FIGS. 21*a,b* are partial cross section views 2100, 2101 of another tactical attachment adapter 2102 specifically fabricated for type 2 (for example Mossberg) firearms of FIGS. 17*a,b,c* in accordance with example embodiments of the present invention. In these embodiments, threaded member 1908 is replaced with bolt 2108. Spring 2104 is retained by the combination of plate 2112 and pins 2106. As an example, an aperture in plate 2112 allows an Allen (hex) wrench to be applied to hex head bolt 2108 for tightening. Alternatively, bolt 2108 many be any suitable configuration, including but not limited to slotted head, Philips head, Torx© head, or hex head cap screw, as will be appreciated by those skilled in the art. Spring detent device 2110 is provided to properly engage with cavities in barrel retaining lug 1704 as previously described. Optionally, adapter 2102 can be machined with a skirt having a cut out which engages with retaining lug 1704 (not shown). This prevents rotation of adapter 2102 when bolt 2108 is tightened, and removes the need for ball detent 2110.

Figure 22:
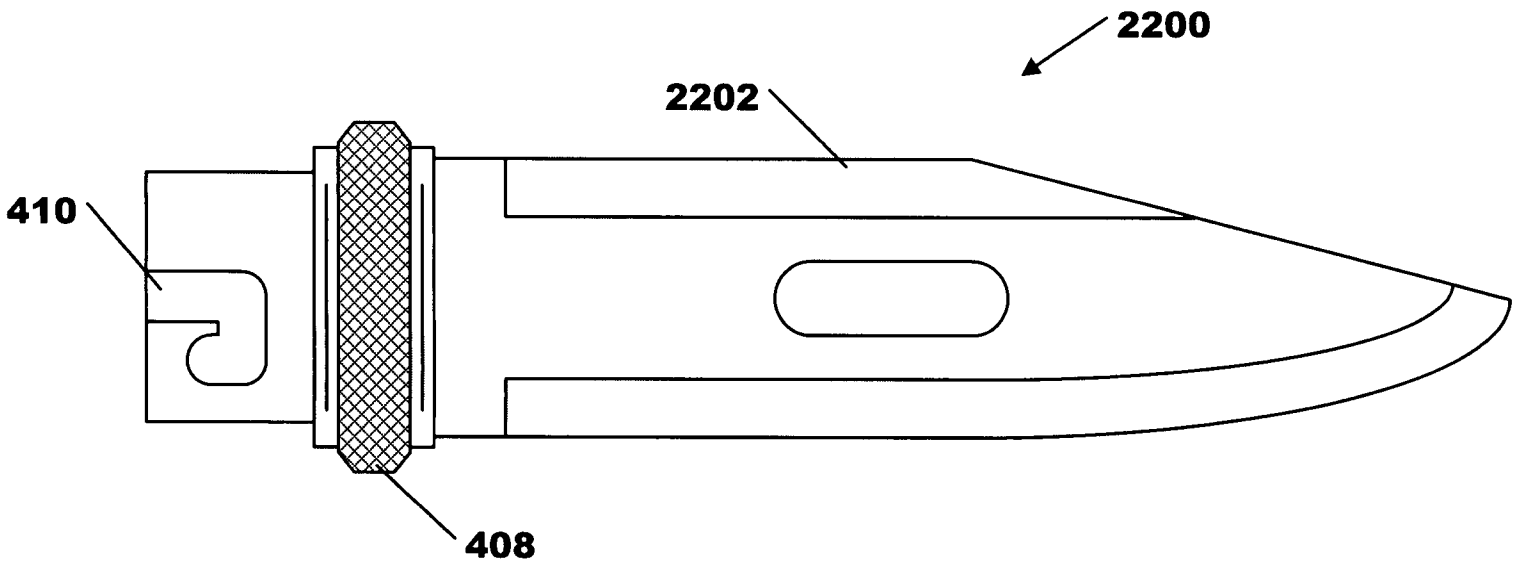
FIG. 22 is a side view of bayonet tactical attachment in accordance with an example embodiment of the present invention.
Figure 23B:
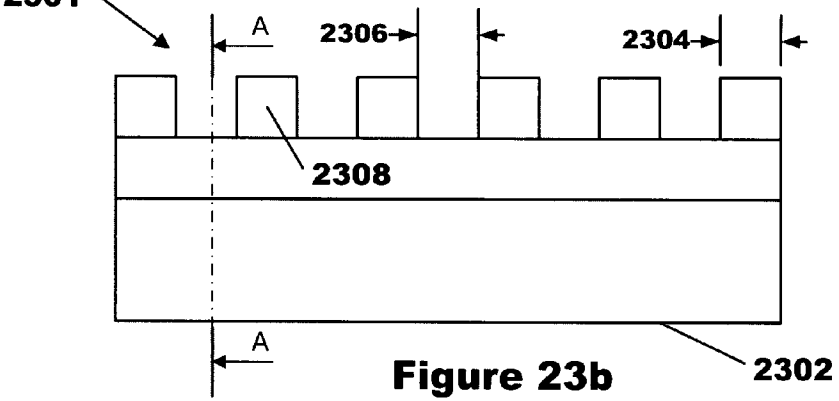
Figure 23b (Prior Art)
FIGS. 23*a-d* (Prior Art) are illustrations of a Picatinny/Weaver auxiliary rail.
Figure 23A:
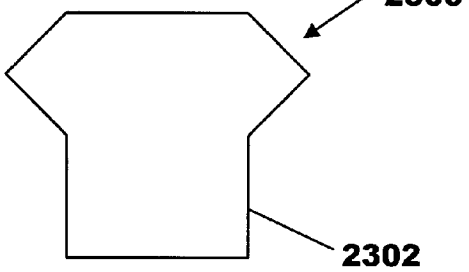
Figure 23a (Prior Art)
Figure 23D:
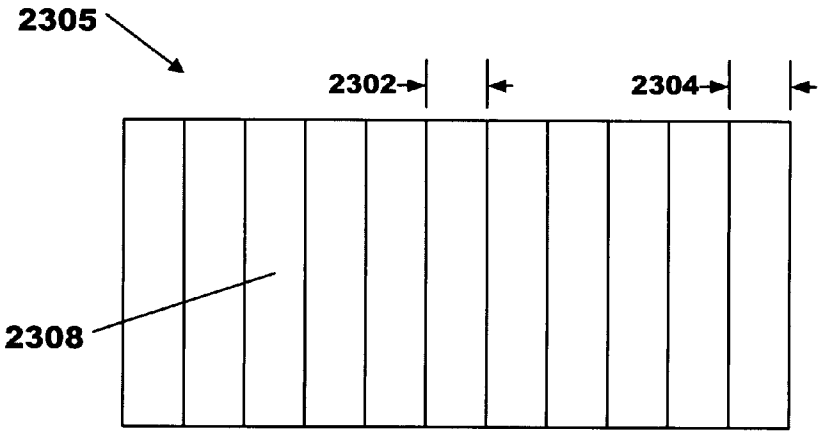
Figure 23d (Prior Art)
Figure 23C:
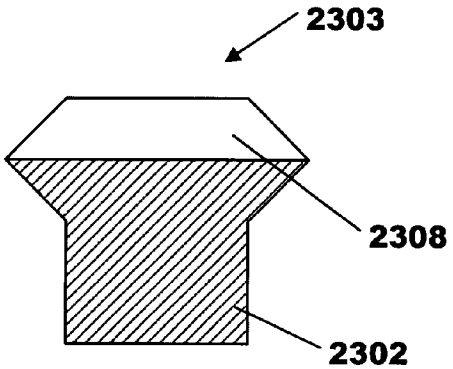
Figure 23c (Prior Art)
Figure 23E:
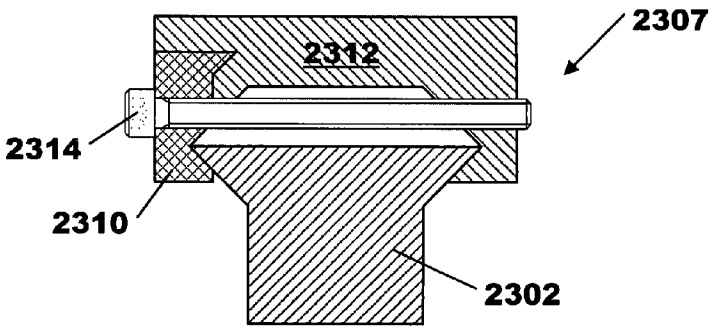
Figure 23e (Prior Art)
FIG. 23*e* (Prior Art) is a partial cross section view of a typical accessory mounted to a Picatinny/Weaver auxiliary rail.
Figure 24B:
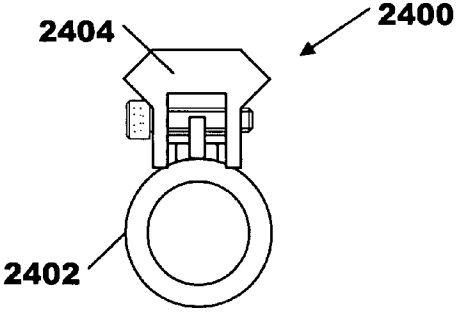
Figure 24b (Prior Art)
FIGS. 24*a,b* (Prior Art) are views of an example Picatinny/Weaver auxiliary rail mounted to a firearm.
Figure 24A:
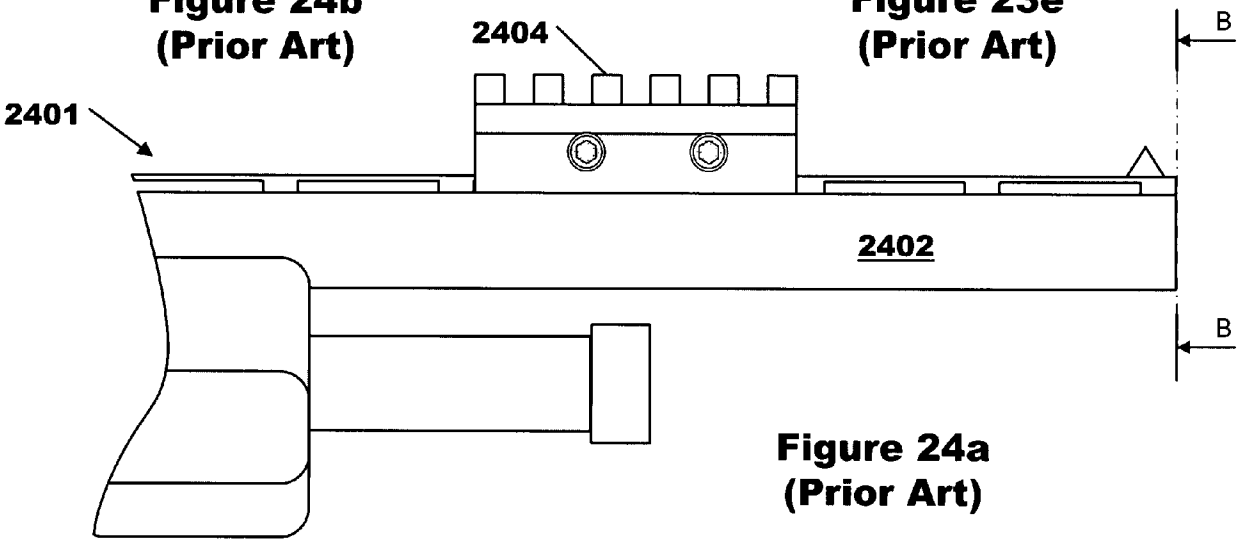
Figure 24a (Prior Art)

FIG. 22 is a side view 2200 of bayonet tactical attachment 2202 in accordance with an example embodiment of the present invention. This tactical attachment is provided with locking ring 408 to prevent loosening of the blade in use. It can be applied to any tactical attachment adapter and quickly replaced if needed.

FIGS. 23 *a-e* (Prior Art) and 24*a,b* (Prior Art) have been discussed above in the BACKGROUND section.

Figure 21B:
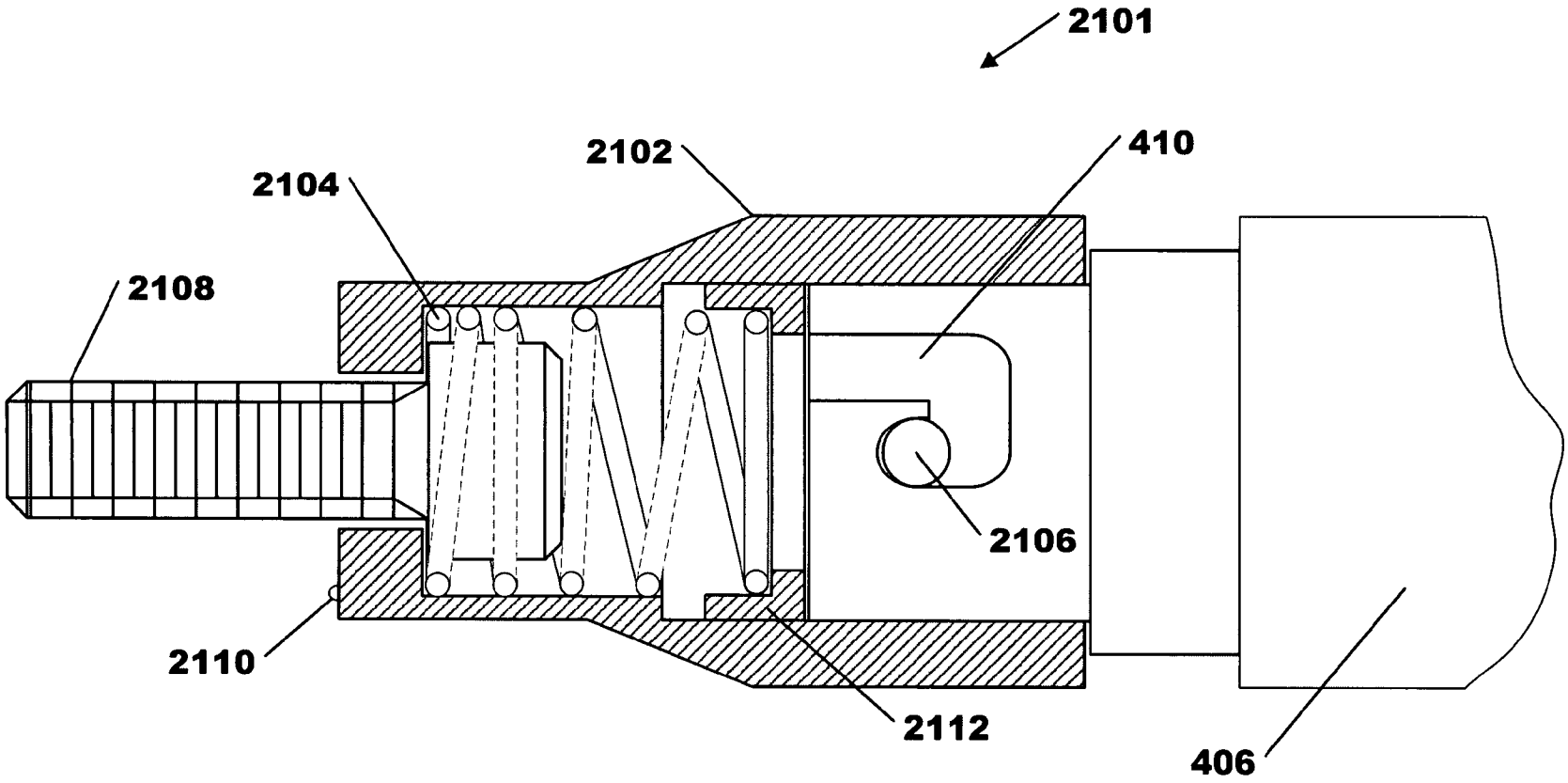
Figure 25B:
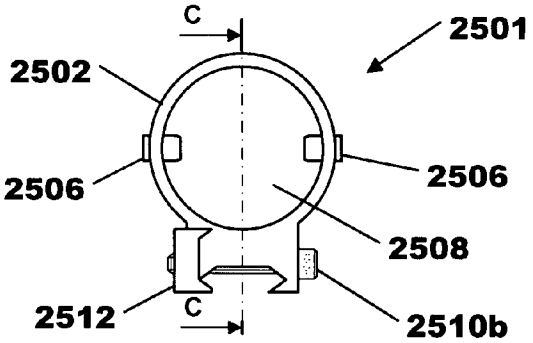
FIG. 25*b* is an end view of a tactical attachment adapter having a Picatinny/Weaver auxiliary rail mount, in accordance with an example embodiment of the present invention.
Figure 25A:
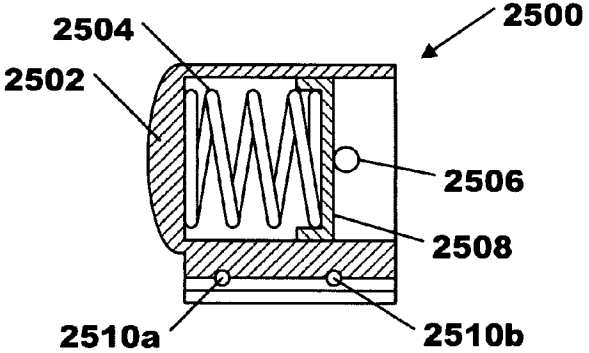
FIG. 25*a* is a cross section view of a tactical attachment adapter having a Picatinny/Weaver auxiliary rail mount, in accordance with an example embodiment of the present invention.

FIG. 25*a* is a cross section view 2500 of a tactical attachment adapter 2502 having a Picatinny/Weaver auxiliary rail mount, in accordance with an example embodiment of the present invention. View is cross section through section C-C of FIG. 25*b*. Spring 2504 is retained by plate 2508, which in turn is retained by pins 2506 when no tactical attachment is engaged with adapter 2502. When a tactical attachment is inserted and locked (not shown, but see FIG. 21*b* for a similar configuration), plate 2508 bears against the rear of the tactical attachment, compressing spring 2504, which in turn maintains a tension force keeping pins 2506 within "J" slot 410 (not shown, refer to FIG. 21*b*). Machined into a portion of the shell of tactical adapter 2504 is a clamping device designed to mate with an auxiliary rail mount system. For example, the auxiliary rail system may be a Weaver rail, Picatinny rail, or similar system. Alternatively, the auxiliary rail system may be a ⅜ (or 11 mm) dovetail mounting system. The auxiliary rail system may be machined into a component on the firearm (such as the gun barrel, ammunition tube, or receiver), or may be attached with clamps or screws as an accessory.

Typically, accessories such as scope gun sights, flashlights, and laser sights are attached to a Weaver/Picatinny rail with clamps that have screws. For an accessory like a telescopic sight, it is generally fastened tightly to the rail to prevent movement or loosening, which will negatively impact targeting precision. To maintain the tight fit, tools are generally required to remove the fasteners that hold the device to the rail. These fasteners can make it difficult to a quickly remove and replace the accessory in the field. Some gun sights have quick removal cams, but due to the symmetry of, for example, the Picatinny rails, the operator has to remember exactly what position the sight was mounted in, or the calibration upon replacement will be incorrect. Embodiments of the present invention of FIGS. 25*a-e* resolve this issue. Once tactical attachment adapter 2504 is mounted to the auxiliary rail system, it never needs to be removed again. Tactical attachments can be mounted and removed at will, in the field with no tools, in a few seconds. Precision is maintained by the pin and slot engagement system, and further reliability can be assured by using a locking ring. Gun sights (not shown) can be used by mounting the gun sight to an auxiliary rail equipped tactical attachment (see, for example, FIGS. 26*a-b*, 27*a-b*, 28 below). Tactical attachment adapter 2504 allows the use of all the tactical attachments heretofore described to be mounted on firearms with auxiliary accessory rails such as Picatinny or Weaver rails, which covers a much broader range of firearms, not just shotguns or long guns with ammunition tubes. The rapid removal/exchange of tactical attachments in the field should not be underestimated. With standard rail systems, an operator often has to equip the weapon with a multiplicity of accessories if the operator wants, for example, a scope, laser sight, and flashlight. This makes the weapon heavy and cumbersome, which can reduce combat effectiveness. With the attachment adapter 2504, a single device is all that is required. One critical accessory (tactical attachment) can be mounted, and others can be carried off weapon, to be deployed in seconds when required. If a tactical attachment fails for some reason (such as a flashlight failing ON), it can be easily removed without compromising the operator's safety or disabling the operator's firearm. Further, due to the pin/slot mounting system employed in adapter 2504, mounting precision and rigidity is not compromised with different attachments mounted to the same tactical attachment adapter.

FIG. 25*b* is an end view 2501 of a tactical attachment adapter 2502 having a Picatinny/Weaver auxiliary rail mount, in accordance with an example embodiment of the present invention. Machined into the shell of adapter 2502 is a cavity 2514 (see FIG. 25*d*) that conforms in shape to the profile of the rail system to which the adapter 2502 is to be mounted. For the example embodiment illustrated, adapter 2502 is configured to fit a Picatinny or Weaver style rail. The Picatinny/Weaver rail system has a modified dovetail type of mounting structure, wherein an opposing set of dual mounting contact surfaces are present on each lug 2308 (see FIGS. 23*b-d*, Prior Art), and only the bottom mounting contact surfaces are present in the "grooves". The grooves are often known as recoil grooves because they are used to prevent sliding of a mounted accessory on the rail during recoil of the weapon. The angle between two adjacent contact mounting surfaces is 90 degrees, or 45 degrees between each surface and the top surface of the rail. The cavity machined in the rail mount portion of tactical attachment adapter 2502 is designed to conform to the shape of the top of rail 2302 and one set of 90 degree mounting surfaces. A bracket device 2512 is fashioned to capture at least one of the opposing mounting surfaces of rail 2302, holding tactical attachment adapter tightly to rail 2302 via bolts 2510. Bolts 2510 are located such that they reside in the "recoil grooves" between the lugs 2308. If positioned correctly (i.e. against the surface of a forward lug) prior to tightening, bolts 2510 will prevent the tactical attachment adapter from moving during recoil of the weapon.

Figure 25D:
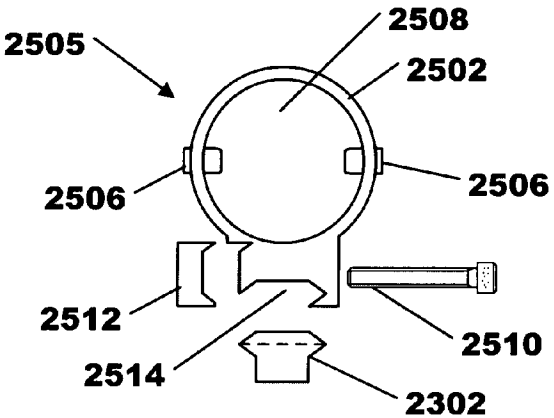
FIG. 25*d* is an exploded end view of the mounting components of a tactical attachment adapter having a Picatinny/Weaver auxiliary rail mount, in accordance with an example embodiment of the present invention.
Figure 25C:
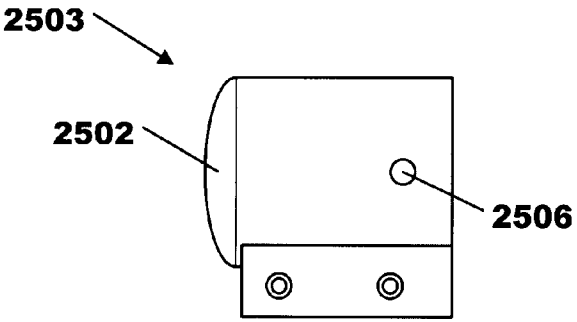
FIG. 25*c* is a side view of a tactical attachment adapter having a Picatinny/Weaver auxiliary rail mount, in accordance with an example embodiment of the present invention.

FIG. 25*c* is a side view 2503 of a tactical attachment adapter 2502 having a Picatinny/Weaver auxiliary rail mount, in accordance with an example embodiment of the present invention.

FIG. 25*d* is an exploded end view 2505 of the mounting components of a tactical attachment adapter 2502 having a Picatinny/Weaver auxiliary rail mount, in accordance with an example embodiment of the present invention.

Figure 26B:
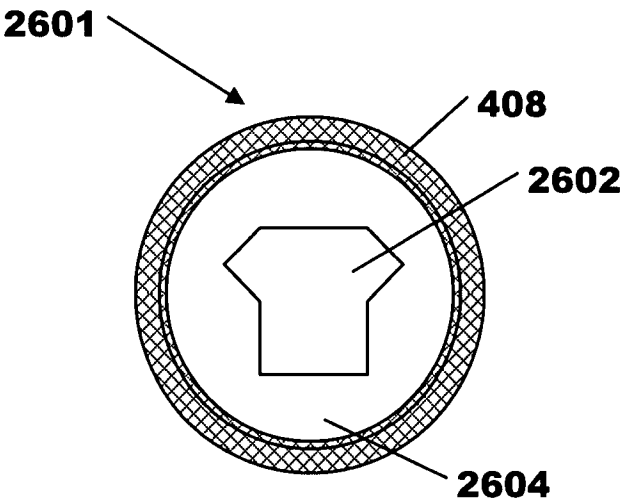
FIG. 26*b* is an end view of a tactical attachment having a Picatinny/Weaver auxiliary rail, in accordance with an example embodiment of the present invention.
Figure 26A:
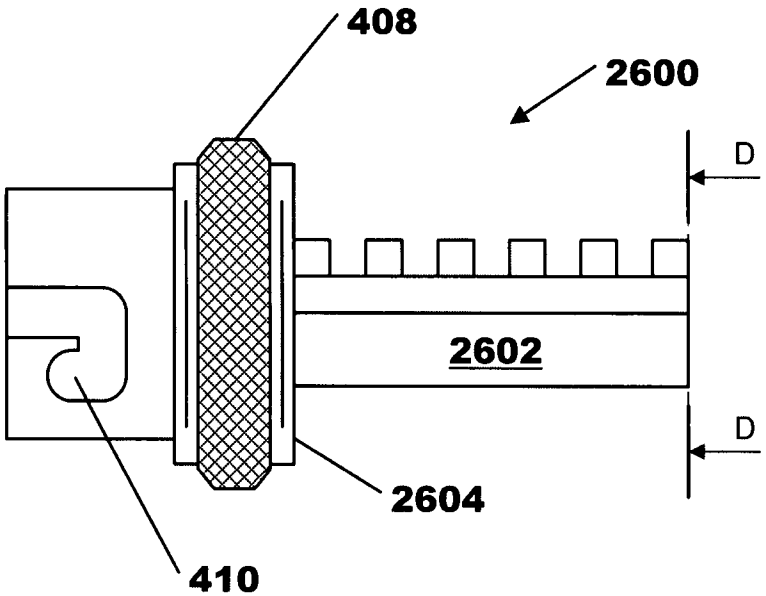
FIG. 26*a* is a side view of a tactical attachment having a Picatinny/Weaver auxiliary rail, in accordance with an example embodiment of the present invention.

FIG. 25 illustrate an adapter for mounting tactical attachments to a auxiliary rail mount system. There may be requirements to mount standardized rail mount accessories to a tactical attachment adapter. This tactical attachment adapter may be any of the embodiments previously discussed, such as those mounted to ammunition tubes or a rail system. The motivation to provide a tactical attachment having a rail mount stems from the desire to use the large variety of devices and accessories manufactured for the Picatinny/Weaver rail mount system, particularly gun sights such as red dot sights, ACOG (Advanced Combat Optical Gunsight) sights, or holographic laser sights. By providing a rail mount tactical adapter, the operator will have the flexibility to add a sophisticated targeting solution to his firearm, while retaining the fast interchangeability of embodiments of the present invention. Once a gun sight is rigidly mounted to the rail on a tactical attachment adapter, it can be easily interchanged with other tactical attachments, without sacrificing rigidity, accuracy, or reliability. This is due to the fact that the operator never has to remove the sight from the rail once its mounted; the pin in slot mount coupled with a locking ring assures proper alignment once engaged, and re-alignment if removed and remounted. This allows the application of many different sights, even those without quick release rail mount attachment. FIG. 26*a* is a side view 2600 of a tactical attachment having a Picatinny/Weaver auxiliary rail 2602, in accordance with an example embodiment of the present invention. FIG. 26*b* is an end view 2601 of a tactical attachment having a Picatinny/Weaver auxiliary rail, via section D-D of FIG. 26*a*. The tactical attachment has an auxiliary rail mount portion 2602 grafted on to a standardized tactical attachment mounting base 2604 as described in previous sample embodiments. Locking ring 408 is a preferred component to this tactical attachment, particularly if a gun sighting system is to be mounted to auxiliary rail portion 2602. As will be acknowledged by those skilled in the art, rail mount portion can be a dove tail mount (not shown) or any future rail mount system yet to be devised.

Figure 27A:
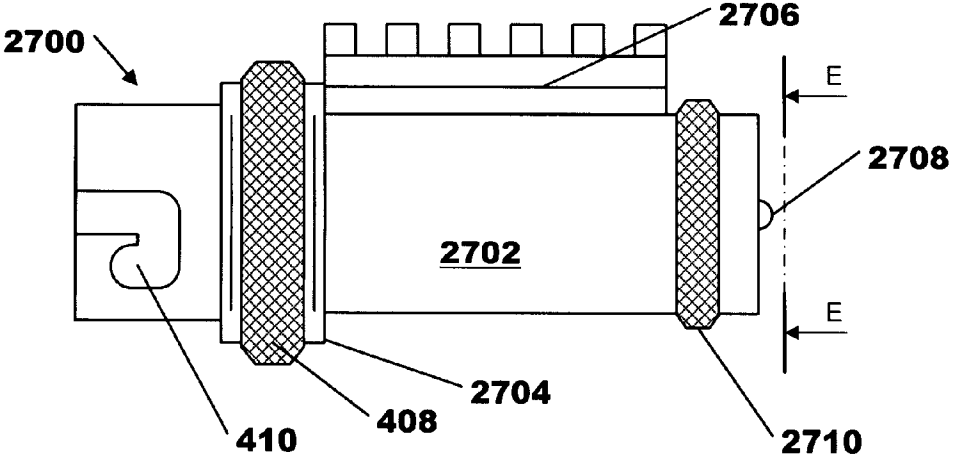
FIG. 27*a* is a side view of laser sight tactical attachment having an integrated Picatinny/Weaver auxiliary rail, in accordance with an example embodiment of the present invention.
Figure 27B:
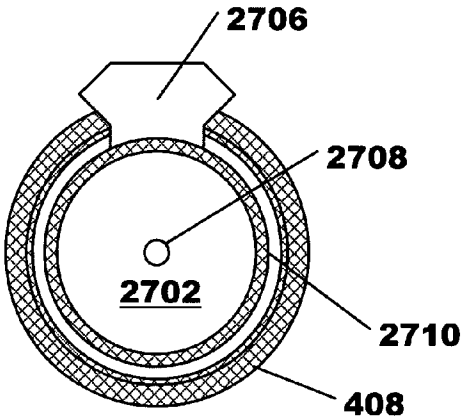
FIG. 27*b* is an end view of laser sight tactical attachment having an integrated Picatinny/Weaver auxiliary rail, in accordance with an example embodiment of the present invention.
Figure 28:
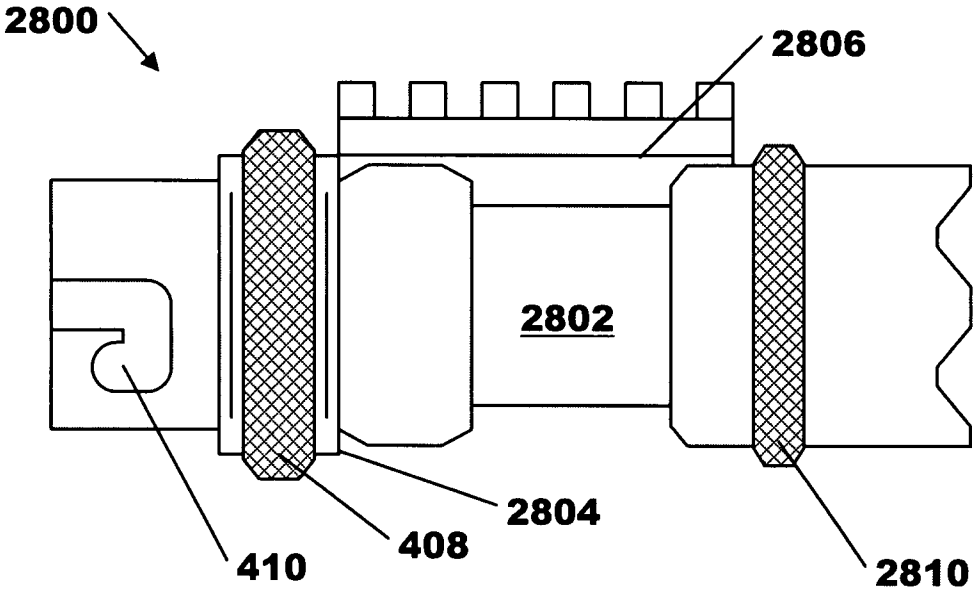
FIG. 28 is a side view of a flashlight tactical attachment having an integrated Picatinny/Weaver auxiliary rail, in accordance with an example embodiment of the present invention.

FIG. 27*a* is a side view 2700 of laser sight tactical attachment 2702 having an integrated Picatinny/Weaver auxiliary rail 2706, in accordance with an example embodiment of the present invention. This tactical attachment 2702 combines the function of a user selectable Picatinny/Weaver rail mount accessory with a laser sight employing a laser diode 2708, both of which mounted to a common tactical attachment base 2704. The laser sight is turned on and off with a rotary actuated switch 2710. This example embodiment allows the combination of two compatible tactical accessories like the laser sight and another rail mounted gun sight such as a red dot sight or holographic sight (not shown). It allows the combination without the need for multiple rails or the concern for coaxial mounting of each accessory. FIG. 27*b* is an end view of laser sight tactical attachment 2702 having an integrated Picatinny/Weaver auxiliary rail, in accordance with an example embodiment of the present invention. FIG. 28 is a side view 2800 of a flashlight tactical attachment 2802 having an integrated Picatinny/Weaver auxiliary rail 2806, grafted to a common tactical attachment base 2804, in accordance with an example embodiment of the present invention. A rotary actuated switch 2810 turns the flashlight on and off.

Figure 29A:
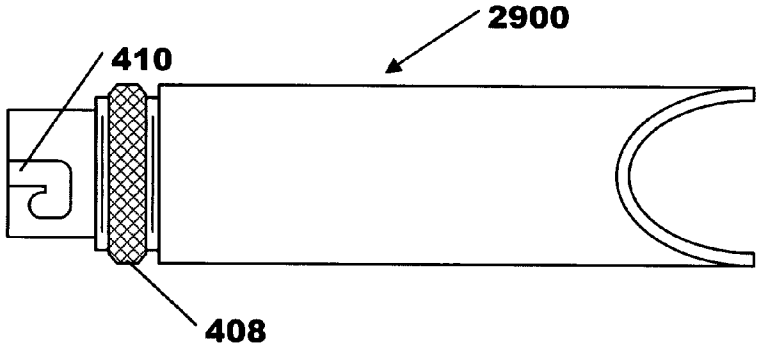
FIG. 29*a* is a side view of a focused point breaching tactical attachment in accordance with an example embodiment of the present invention.
Figure 29B:
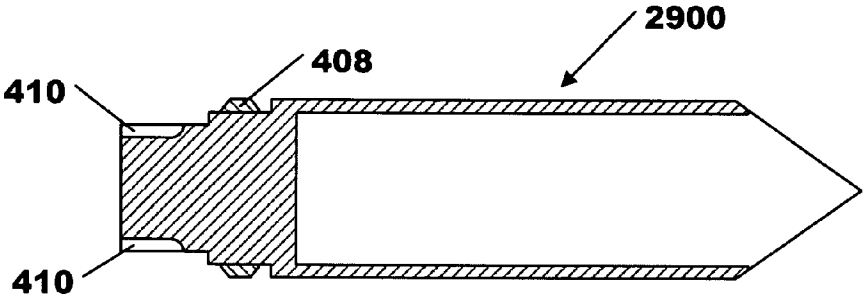
FIG. 29*b* is a cross section top view of a focused point breaching tactical attachment in accordance with an example embodiment of the present invention.
Figure 29C:
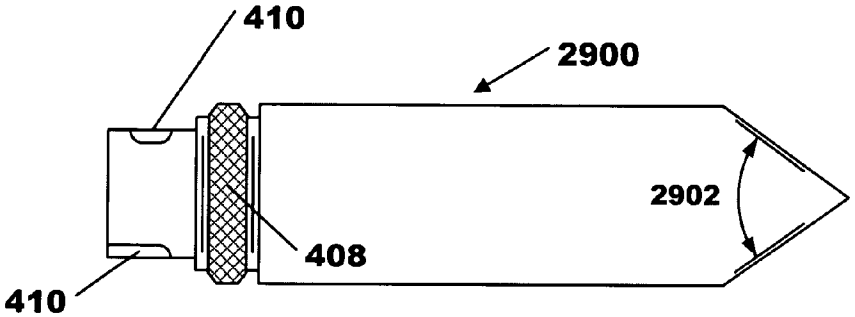
FIG. 29*c* is a top view of a focused point breaching tactical attachment in accordance with an example embodiment of the present invention.

FIG. 29*a* is a side view of a focused point breaching tactical attachment 2900 in accordance with an example embodiment of the present invention. The tactical attachment 2900 of FIGS. 29*a-c* differs from the breaching tool shown in FIGS. 9*a-c* in that instead of having a "saw toothed" end, the end is fashioned into a single focused point, having an angle 2902. The focused point allows better placement of the shotgun or firearm muzzle within tight corners. This tool is primarily used by military and law enforcement personnel to blow out locks and door hinges to allow forced entry to buildings and enclosed rooms. Angle 2902 can vary from between 45 degrees to 135 degrees, but is preferably between 75 to 105 degrees. The tip can be described by the intersection of two planar surfaces and the cylindrical breacher tube. The intersection of the two planes defines a line, and the line of intersection of the aforementioned planar surfaces is perpendicular with the longitudinal axis of the breaching tube. The focused point breaching tactical attachment 2900 can be used with or without locking ring 408, but it's use is preferred to properly and reliably secure the breaching tool to the shotgun. FIG. 29*b* is a cross section top view of a focused point breaching tactical attachment 2900. FIG. 29*c* is a top view of breaching tactical attachment 2900. Tactical attachment 2900 can be utilized with any of the afore described tactical attachment adapters.

Figure 30B:
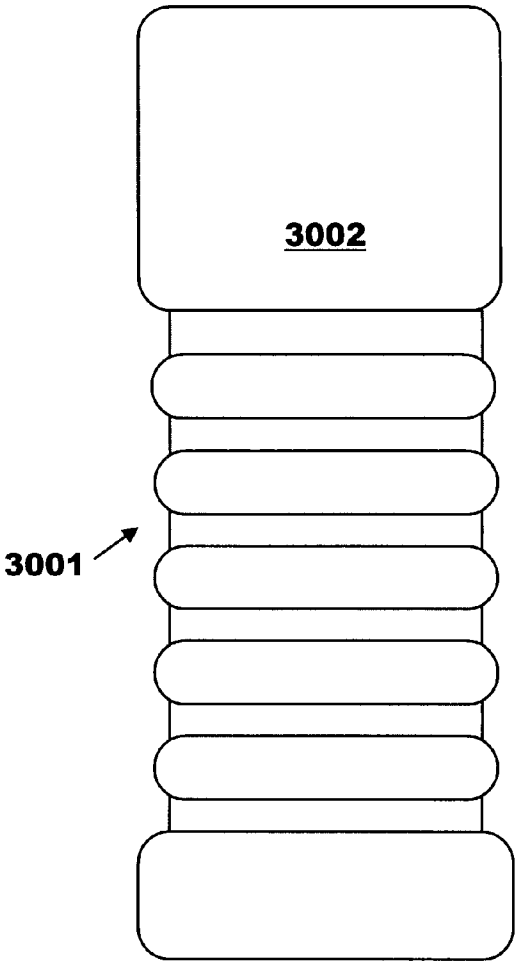
FIG. 30*b* is an end view of a pistol grip tactical attachment in accordance with an example embodiment of the present invention.
Figure 30A:
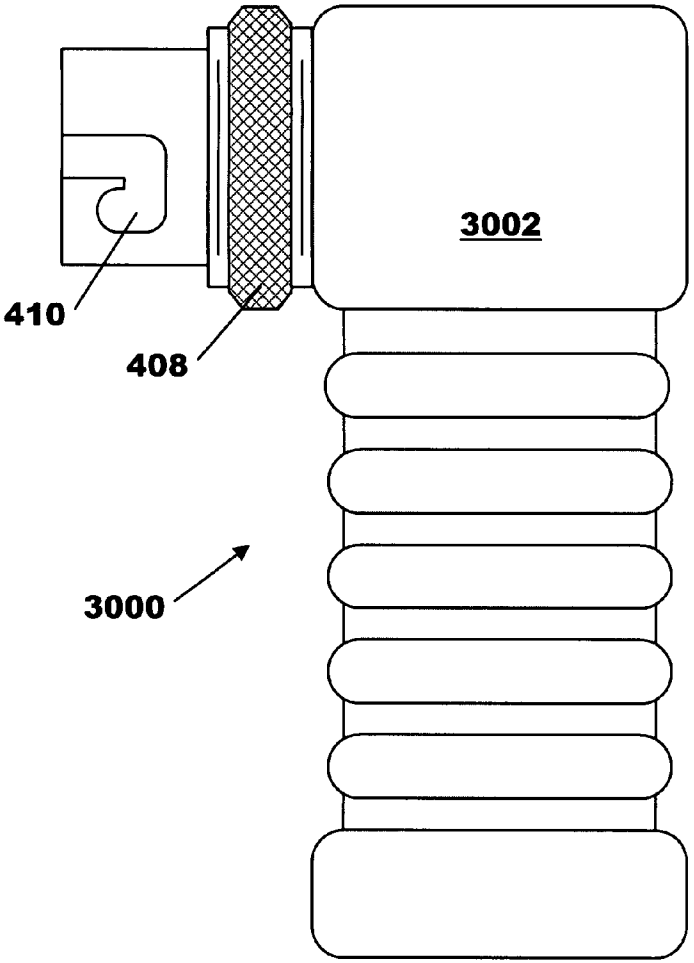
FIG. 30*a* is a side view of a pistol grip tactical attachment in accordance with an example embodiment of the present invention.

FIG. 30*a* is a side view 3000 of a pistol grip tactical attachment 3002 in accordance with an example embodiment of the present invention. Pistol grips (otherwise known as fore grips) are accessories applied to the forward end of long guns or carbines to steady the aim and control the firearm during discharge. Pistol grip tactical attachment 3002 utilizes the same pin and slot attachment system heretofore described to mount to tactical attachment adapters. FIG. 30*b* is an end view 3001 of a pistol grip tactical attachment 3002. Pistol grip tactical attachment 3002 can be used with or without locking ring 408.

Figure 31B:
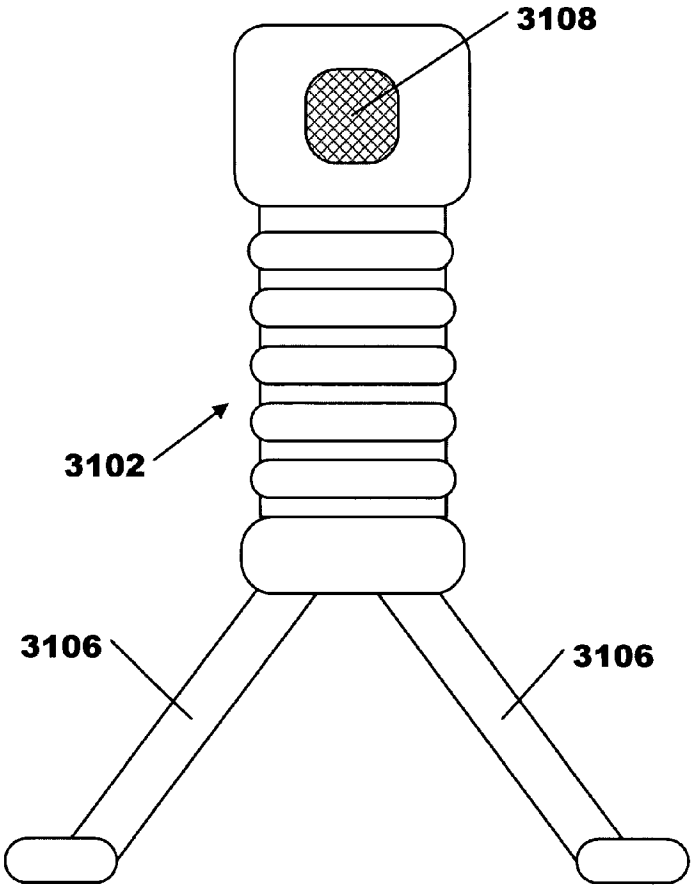
FIG. 31*b* is an end view of a pistol grip tactical attachment incorporating bi-pod support legs in accordance with an example embodiment of the present invention.
Figure 31A:
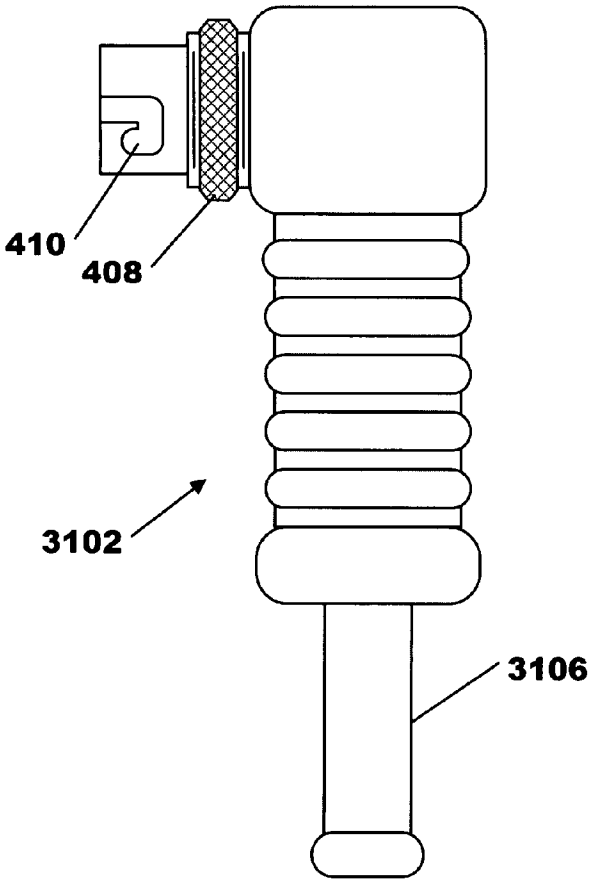
FIG. 31*a* is a side view of a pistol grip tactical attachment incorporating bi-pod support legs in accordance with an example embodiment of the present invention.
Figure 32B:
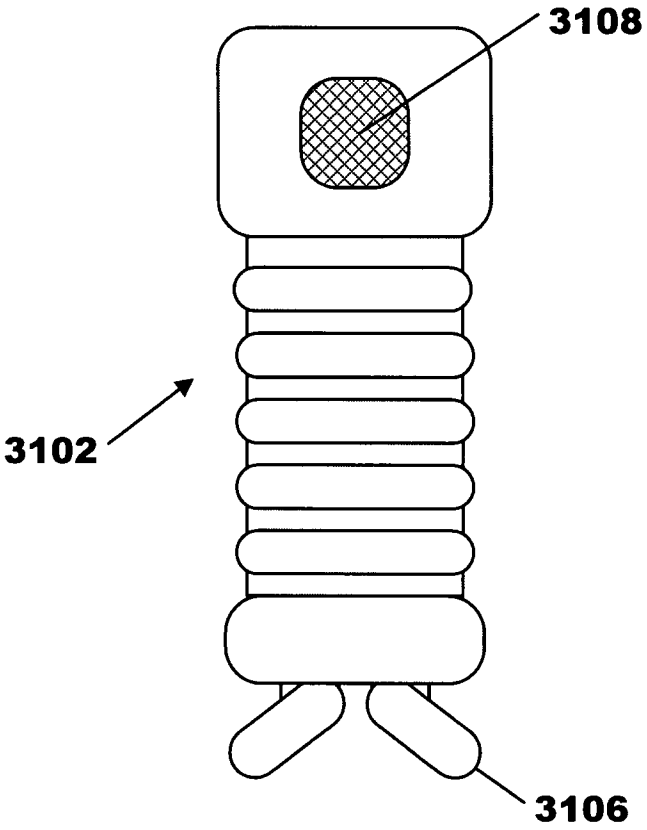
FIG. 32*b* is an end view of a pistol grip tactical attachment incorporating bi-pod support legs stored within the grip, in accordance with an example embodiment of the present invention.
Figure 32A:
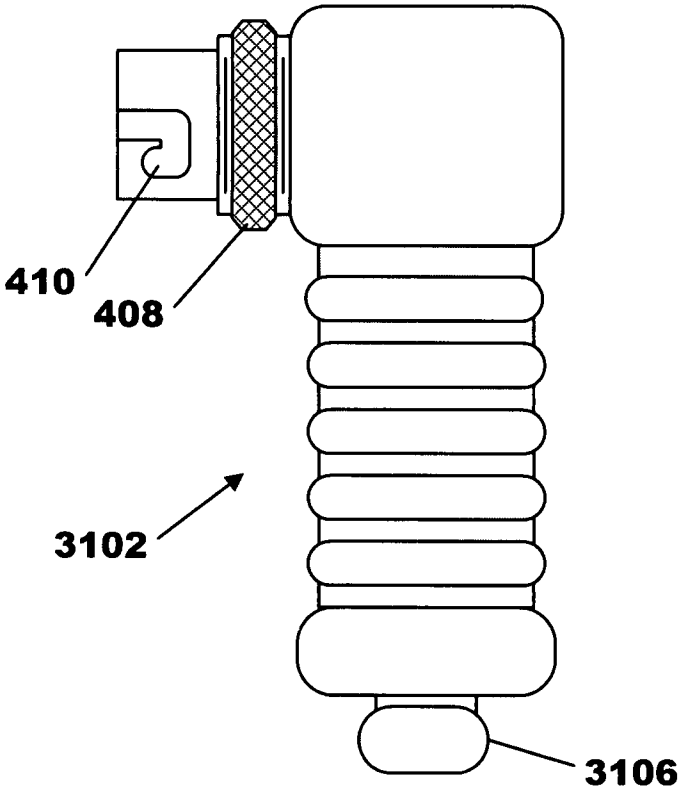
FIG. 32*a* is a side view of a pistol grip tactical attachment incorporating bi-pod support legs stored within the grip, in accordance with an example embodiment of the present invention.

FIGS. 31 and 32 describe a pistol grip tactical attachment having stow able bipod legs, in accordance with example embodiments of the present invention. The legs are stored within the grip when not utilized, and can be extended and deployed when required to provide stability and precision when aiming the firearm. FIG. 31*a* is a side view of a pistol grip tactical attachment 3102 incorporating bi-pod support legs 3106. FIG. 31*b* is an end view of pistol grip tactical attachment 3102. Release button 3108 deploys legs 3106 via a spring and piston system housed within grip 3102 (not shown). FIG. 32*a* is a side view of the pistol grip tactical attachment 3102 having the bi-pod support legs 3106 stored within the grip. FIG. 32*b* is an end view of pistol grip tactical attachment 3102 of FIG. 32*a*.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

What is claimed is:

1. A system for mounting a tactical attachment focused point breaching tool to a firearm having an ammunition tube with a threaded bore and a barrel retaining lug, said system comprising:

a tactical attachment adapter, said tactical attachment adapter having a firearm mounting end and an opposing tactical attachment mounting end, said firearm mounting end having a first bore fashioned therein, said tactical attachment mounting end having a cavity fashioned therein, said tactical attachment mounting end having one or more pins extending into said cavity;

a mounting bolt, said mounting bolt passing through said first bore in said firearm mounting end of said tactical adapter, engaging said threaded bore of said ammunition tube of said firearm through a clearance bore in said barrel retaining lug; and a tactical attachment breaching tool, said breaching tool having a mounting structure fixed to a first end of a cylindrical tube, said mounting structure having a first portion and a second portion, said first portion of said mounting structure having one or more "J" shaped slots fashioned within an outer surface, said first portion of said mounting structure being inserted into said cavity fashioned within said tactical attachment mounting end of said tactical attachment adapter such that said one or more pins extending into said cavity are engaged within a hook portion of said one or more "J" shaped slots, said second portion of said mounting structure fixed to said first end of said cylindrical tube, a second end of said cylindrical tube having a pointed structure fashioned therein, said pointed structure defined by an intersection of two planes, a line of intersection of said two planes perpendicular to a longitudinal axis of said cylindrical tube, wherein said tactical attachment adapter has a second bore fashioned therein, said second bore in said tactical attachment adapter extending from said first bore fashioned within said firearm mounting end to said cavity, said second bore in said tactical attachment adapter having a spring and a retaining plate inserted therein, said retaining plate having a first surface in contact with said outer surface of said first portion of said tactical attachment breaching tool mounting structure, said mounting plate having a second opposing surface in contact with said spring, said spring captured between said firearm mounting end of said tactical attachment adapter and said mounting plate.

2. The system as recited in claim 1, wherein said angle between said two planes defining the pointed structure of said cylindrical tube is between 45 and 135 degrees.

3. The system as recited in claim 2, wherein said angle between said two planes defining the pointed structure of said cylindrical tube is between 75 and 105 degrees.

4. The system as recited in claim 1, wherein said second portion of said tactical attachment mounting structure comprises a locking ring, said locking ring engaging an external threaded surface on said second portion of said tactical attachment mounting structure, said locking ring operative to provide tension between said tactical attachment and said tactical attachment adapter.

5. A system for mounting a tactical attachment focused point breaching tool to a firearm having an ammunition tube and an ammunition spring mounted therein, said system comprising:

a tactical attachment adapter, said tactical attachment adapter having an ammunition tube mounting end and an opposing tactical attachment mounting end, said ammunition tube mounting end removably mounted to an end of said ammunition tube of said firearm, said tactical attachment mounting end having a cavity fashioned therein, said tactical attachment mounting end having one or more pins extending into said cavity; and a tactical attachment breaching tool, said breaching tool having a mounting structure fixed to a first end of a cylindrical tube, said mounting structure having a first portion and a second portion, said first portion of said mounting structure having one or more "J" shaped slots fashioned within an outer surface, said first portion of said mounting structure being inserted into said cavity fashioned within said tactical attachment mounting end of said tactical attachment adapter such that said one or more pins extending into said cavity are engaged within a hook portion of said one or more "J" shaped slots, said second portion of said mounting structure fixed to said first end of said cylindrical tube, a second end of said cylindrical tube having a pointed structure fashioned therein, said pointed structure defined by an intersection of two planes, a line of intersection of said two planes perpendicular to a longitudinal axis of said cylindrical tube, wherein said tactical attachment adapter has a bore fashioned therein, said bore extending from said ammunition tube mounting end to said cavity, said bore having a piston inserted therein, said piston having a first surface in contact with said outer surface of said tactical attachment mounting structure, said piston having a second opposing surface in contact with said ammunition spring.

6. The system as recited in claim 5, wherein said angle between said two planes defining the pointed structure of said cylindrical tube is between 45 and 135 degrees.

7. The system as recited in claim 6, wherein said angle between said two planes defining the pointed structure of said cylindrical tube is between 75 and 105 degrees.

8. The system as recited in claim 5, wherein said second portion of said tactical attachment mounting structure comprises a locking ring, said locking ring engaging an external threaded surface on said second portion of said tactical attachment mounting structure, said locking ring operative to provide tension between said tactical attachment and said tactical attachment adapter.

* * * * *